US007430395B2

(12) United States Patent
Iwaishi et al.

(10) Patent No.: US 7,430,395 B2
(45) Date of Patent: Sep. 30, 2008

(54) FLASH FIXING DEVICE AND IMAGE FORMING DEVICE

(75) Inventors: Akira Iwaishi, Kanagawa (JP); Mitsuhiro Mori, Kanagawa (JP); Hiroshi Nou, Kanagawa (JP); Kouichi Sanpei, Kanagawa (JP); Kunihiko Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 203 days.

(21) Appl. No.: 11/402,824

(22) Filed: Apr. 13, 2006

(65) Prior Publication Data

US 2006/0291926 A1 Dec. 28, 2006

(30) Foreign Application Priority Data

Jun. 28, 2005 (JP) ..... 2005-188361

(51) Int. Cl.
*G03G 15/20* (2006.01)

(52) U.S. Cl. ..... 399/336

(58) Field of Classification Search ..... 399/336, 399/337

See application file for complete search history.

(56) References Cited

U.S. PATENT DOCUMENTS 5,521,689 A * 5/1996 Miyakoshi ..... 399/336
2001/0006584 A1* 7/2001 Yoshida et al. ..... 399/67
2003/0231909 A1* 12/2003 Kishimoto et al. ..... 399/336

FOREIGN PATENT DOCUMENTS

JP 54111356 A * 8/1979
JP A-2001-142347 5/2001

* cited by examiner

*Primary Examiner*—Ryan Gleitz
(74) *Attorney, Agent, or Firm*—Morgan, Lewis & Bockius LLP

(57) ABSTRACT

A flash fixing device is disclosed. The flash fixing device has a group of main flash lamps which emit main flash light for fixing a toner image on a recording medium; an auxiliary flash lamp provided at a position corresponding to between a pair of flash lamps of the group of main flash lamps; and a light-emission control unit controlling light-emission of the group of main flash lamps and light-emission of the auxiliary flash lamp by using a predetermined relationship. Also disclosed is an image forming device having the flash fixing device.

18 Claims, 26 Drawing Sheets

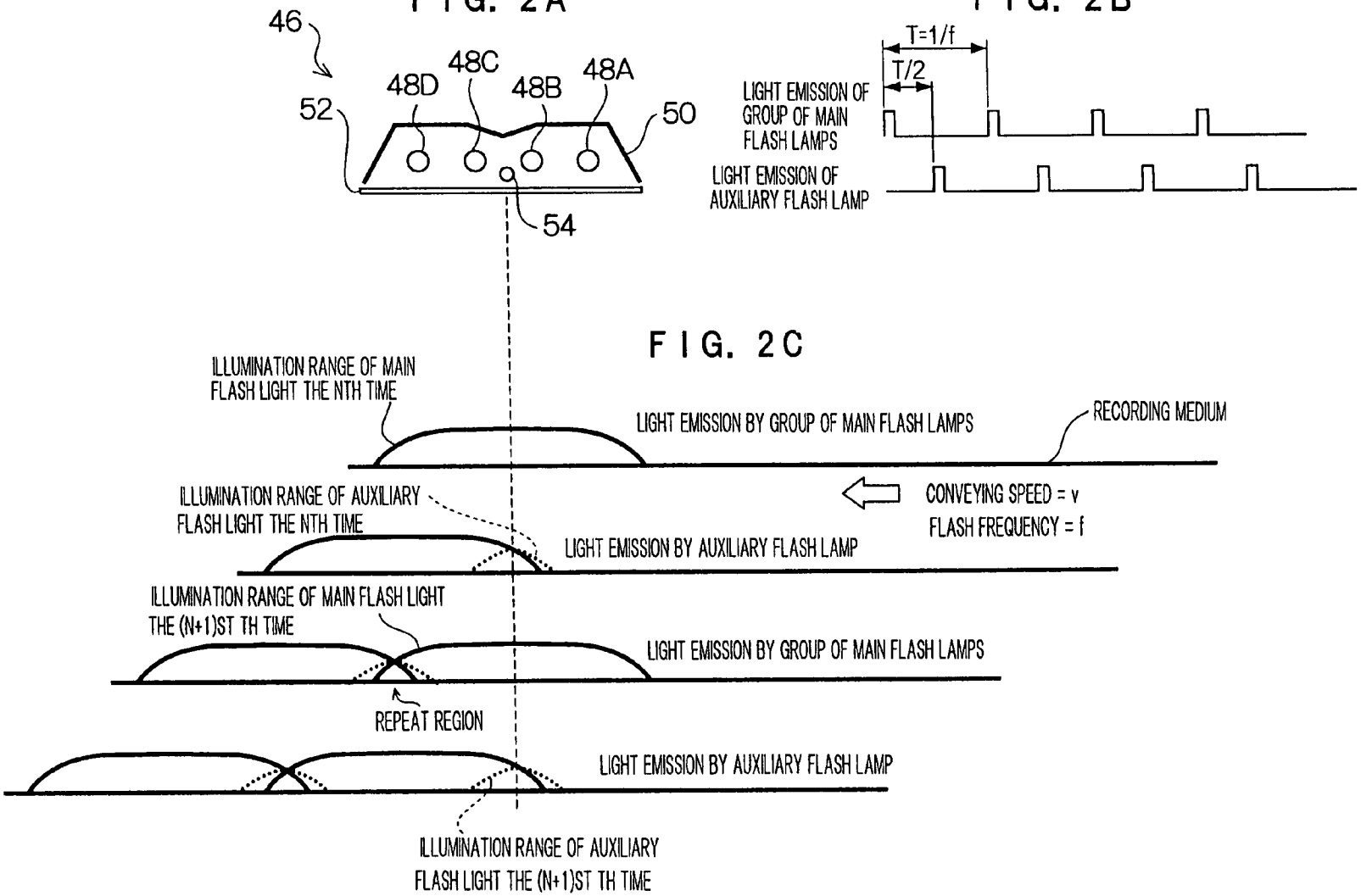
FIG. 2A
46
52
48D
48C
48B
48A
50
54
FIG. 2B
T=1/f
T/2
LIGHT EMISSION OF GROUP OF MAIN FLASH LAMPS
LIGHT EMISSION OF AUXILIARY FLASH LAMP
FIG. 2C
RECORDING MEDIUM
CONVEYING SPEED = v
FLASH FREQUENCY = f
LIGHT EMISSION BY GROUP OF MAIN FLASH LAMPS
LIGHT EMISSION BY AUXILIARY FLASH LAMP
LIGHT EMISSION BY GROUP OF MAIN FLASH LAMPS
LIGHT EMISSION BY AUXILIARY FLASH LAMP
ILLUMINATION RANGE OF MAIN FLASH LIGHT THE NTH TIME
ILLUMINATION RANGE OF AUXILIARY FLASH LIGHT THE NTH TIME
ILLUMINATION RANGE OF MAIN FLASH LIGHT THE (N+1)ST TH TIME
REPEAT REGION
ILLUMINATION RANGE OF AUXILIARY FLASH LIGHT THE (N+1)ST TH TIME

RELATIONSHIP BETWEEN HEATER OUTPUT AND CORRECTION AMOUNT $$Ft_x = \frac{1}{f}\left\{\frac{L_x - \frac{(W - v/f)}{2}}{v/f}\right\}$$

Ft_x: LIGHT-EMISSION TIME OF AUXILIARY LAMP
L_x: POSITION OF AUXILIARY LAMP
W: OPENING WIDTH OF REFLECTING PLATE
v: CONVEYING SPEED
f: FLASH FREQUENCY

TEMPERATURE DISTRIBUTION OF LED SUBSTRATE

FLASH FIXING DEVICE AND IMAGE FORMING DEVICE

CROSS-REFERENCE TO RELATED APPLICATION

This application claims priority under 35 USC 119 from Japanese Patent Application No. 2005-188361, the disclosure of which is incorporated by reference herein.

BACKGROUND OF THE INVENTION

1. Field of the Invention

The present invention relates to a flash fixing device and an image forming device. More particularly, the present invention relates to a flash fixing device which fixes a toner image, which has been transferred onto a recording medium, by illuminating flash light emitted from flash lamps, and to an image forming device equipped with the flash fixing device.

2. Description of the Related Art

An image forming device, which forms images by an electrophotographic method, transfers, onto a recording medium, a toner image formed by powder toner, and thereafter, applies thermal energy to the recording medium on which the toner image is transferred (i.e., to the powder toner on the recording medium) and fuses the powder toner, thereby fixing the toner image on the recording medium. A heat roller is usually used in order to supply the thermal energy for toner image fixing. However, high-capacity image forming devices which can form a large amount of images at high speed (e.g., an image forming device which can form images on recording medium of a surface area of about 500 A4-sized sheets per second) use a flash fixing system which illuminates flash lamps intermittently, and by illuminating the flash light which is emitted from the flash lamps when the flash lamps are lit, supplies the energy for fusing the powder toner and fixing the toner image. Because the flash fixing system can supply high energy without contacting the recording medium, it does not affect the conveying of the recording medium and is suitable for high-speed image formation.

In its main applications, document printing in high-capacity image forming devices is usually monochrome. However, even in document printing the need for color printing is gradually increasing for high-capacity image forming devices, such as, for example, when it is desired to print in color a company logo to be added as a header or a footer to a document, or the like. Formation of color images in an electrophotographic system can be realized by superposing toner images of the respective colors of C, M, Y (and K). However, accompanying this, the amount of toner which is transferred onto the recording medium (the amount of toner which is the object of fixing) increases, and the need arises to supply a large amount of energy in order to fix the toner image.

In a flash fixing system, increasing the energy which is supplied can be realized by decreasing the speed of conveying the recording medium (for example, if the conveying speed is halved, the supplied energy is doubled), or by shortening the light-emission cycle time of the flash lamps (for example, if the light-emission cycle time is halved (the light-emission frequency is doubled), the supplied energy is doubled). However, there are the problems that decreasing the conveying speed of the recording medium is not desirable, as it relates to a deterioration in the processing capacity of the image forming device, and shortening the light-emission cycle time of the flash lamps as well leads to shortening of the lifespan of the flash lamps and the rise in the temperature of the lamps also is great. Therefore, in order to increase the supplied energy without decreasing the conveying speed or shortening the light-emission cycle time, there have come to be generally employed structures in which plural flash lamps are arranged along the conveying direction of the recording medium, and by causing these flash lamps to emit light simultaneously, flash light is illuminated over a relatively broad surface area on the recording medium in the light emission of a single time.

In connection with the above, Japanese Patent Application Laid-Open (JP-A) No. 2001-142347 discloses a flash fixing device equipped with a flash power source section which supplies electric power such that, during the time when the flash lamps are emitting light, the discharge current flowing to the flash lamps is substantially even.

However, in a case in which plural flash lamps, which are arranged along the conveying direction of the recording medium, are made to emit light simultaneously, the light distribution pattern becomes a pattern in which, as shown in FIG. 25A as an example, the amount of illuminated light of the flash light is substantially uniform at the central portion in the recording medium conveying direction, but, in vicinities of the two end portions in the recording medium conveying direction, the further away from the central portion, the more the amount of illuminated light of the flash light decreases gently. Note that, although FIG. 25A illustrates a case in which there are four flash lamps, however the light distribution pattern becomes a pattern in which the amount of illuminated light of the flash light decreases in vicinities of the two end portions as described above if the number of flash lamps is plural, even if it is other than four.

Therefore, in a case in which flash light is illuminated onto a recording medium by causing plural flash lamps to emit light simultaneously, a conveying speed v of the recording medium and a light-emission frequency f of the flash lamps (f=1/light-emission period T) are adjusted such that, at the portions of the recording medium illuminated by the flash light corresponding to the low light amount portions in the light distribution pattern (the vicinities of the two end portions), the flash light corresponding to the low light amount portions is illuminated two times, as shown in FIG. 25B. Note that, at the recording medium, a length S along the recording medium conveying direction of a region where the flash light is illuminated only one time (called a "single-flash region"), and a length D along the recording medium conveying direction of a portion where the flash light is illuminated two times (called a "repeat region"), are such that $D=W-v/f$ and $S=W-D$, where W is the width of the opening of the flash lamp unit (see FIG. 25A).

However, due to the amount of the toner to be fixed increasing due to the image being formed in color as described above, the problem arises that the image quality deteriorates in the aforementioned repeat regions. Namely, in the stage before the flash light is illuminated onto the recording medium, the toner on the recording medium is all in a powder state as shown by (1) in FIG. 26B. When the flash light is illuminated, energy is supplied, and fusing of the toner occurs. However, although the flash light is illuminated two times in the repeat region, the amount of illuminated light of the flash light in the illumination each time is small, and therefore, the toner surface temperature and the recording medium interface temperature at the repeat region vary as shown in FIG. 26A.

More specifically, during the illumination of the flash light the first time, the surface of the toner at the upper layer side in the repeat region fuses due to the temperature exceeding the toner fusing temperature (softening). However, the temperature of the toner of the lower layer side in the repeat region does not reach the toner fusing temperature, and therefore, fusing does not occur (see (2) in FIG. 26B). Further, during the period of time from after the illumination of flash light the first time is carried out and time corresponding to the light-emission period T elapses and the illumination of flash light the second time is carried out, energy is not supplied to the toner at the repeat region. Therefore, the temperature of the toner decreases due to heat dissipation, and the fused toner of the upper layer side begins to cohere due to surface tension (see (3) in FIG. 26B). Further, due to the temperature of the toner at the upper layer side decreasing greatly during the period of time until the illumination of the flash light is carried out a second time, the toner of the lower layer side which is in the state of a powder is pulled, due to the strong surface tension of the toner of the upper layer side, and deterioration in image quality, such as missing dots (white spots) called voids where the surface of the recording medium is uncovered, or the like, arises (see (4) of FIG. 26B).

SUMMARY OF THE INVENTION

The present invention was made in view of the above-described circumstances, and provides a flash fixing device, and an image forming device, in which a toner image transferred onto a recording medium can be fixed without deterioration in image quality arising, even at a repeat region of the recording medium where flash light corresponding to a low light amount portion of the light distribution pattern is illuminated plural times.

A first aspect of the present invention provides a flash fixing device including: a group of main flash lamps, formed by plural flash lamps that emit main flash light for fixing a toner image which is transferred onto a recording medium; a light-emission control unit that causes the group of main flash lamps to emit light intermittently, and controls light-emission of the group of main flash lamps such that flash light of a low light amount is illuminated two times onto a region of a recording medium, on which a toner image to be fixed is transferred and which is moved in a predetermined direction relative to the group of main flash lamps, the region illuminated by the flash light of the low light amount being at an end portion vicinity in the predetermined direction in a light distribution pattern of the main flash light from the group of main flash lamps; and an auxiliary flash lamp provided at a position corresponding to between a pair of flash lamps of the group of main flash lamps positioned at the two end portions in the predetermined direction. Wherein the light-emission control unit is structured so as to effect control such that the auxiliary flash lamp emits light when a repeat region of the recording medium at which the flash light of the low light amount is illuminated two times corresponds to an illumination position where auxiliary flash light from the auxiliary flash lamp is illuminated.

Another aspect of the present invention provides an image forming device including: an image forming section that forms a toner image on an image carrier, and transfers the formed toner image onto a recording medium; and a flash fixing device that fixes the toner image transferred onto the recording medium by illuminating flash light onto the recording medium. The flash fixing device including: a group of main flash lamps formed by plural flash lamps that emit main flash light for fixing the toner image transferred onto the recording medium; a light-emission control unit that causes the group of main flash lamps to emit light intermittently, and controls light-emission of the group of main flash lamps such that flash light of a low light amount is illuminated two times onto a region of the recording medium, on which the toner image to be fixed is transferred and which is moved in a predetermined direction relative to the group of main flash lamps, the region illuminated by the flash light of the low light amount being at a vicinity of an end portion in the predetermined direction in a light distribution pattern of the main flash light from the group of main flash lamps; and an auxiliary flash lamp provided at a position corresponding to between a pair of flash lamps of the group of main flash lamps positioned at the two end portions in the predetermined direction. Wherein the light-emission control unit is structured so as to effect control such that the auxiliary flash lamp emits light when a repeat region of the recording medium at which the flash light of the low light amount is illuminated two times corresponds to an illumination position where auxiliary flash light from the auxiliary flash lamp is illuminated.

BRIEF DESCRIPTION OF THE DRAWINGS

Preferred embodiments of the present invention will be described in detail based on the following figures, in which:

FIG. 2A is a schematic diagram showing an example of a flash fixing unit;

FIG. 2B is a timing chart showing light-emission timings of a group of main flash lamps and an auxiliary flash lamp;

FIG. 2C is a schematic diagram showing the progression of illumination of flash light onto respective portions on a recording medium;

DETAILED DESCRIPTION OF THE INVENTION

Figure 1:
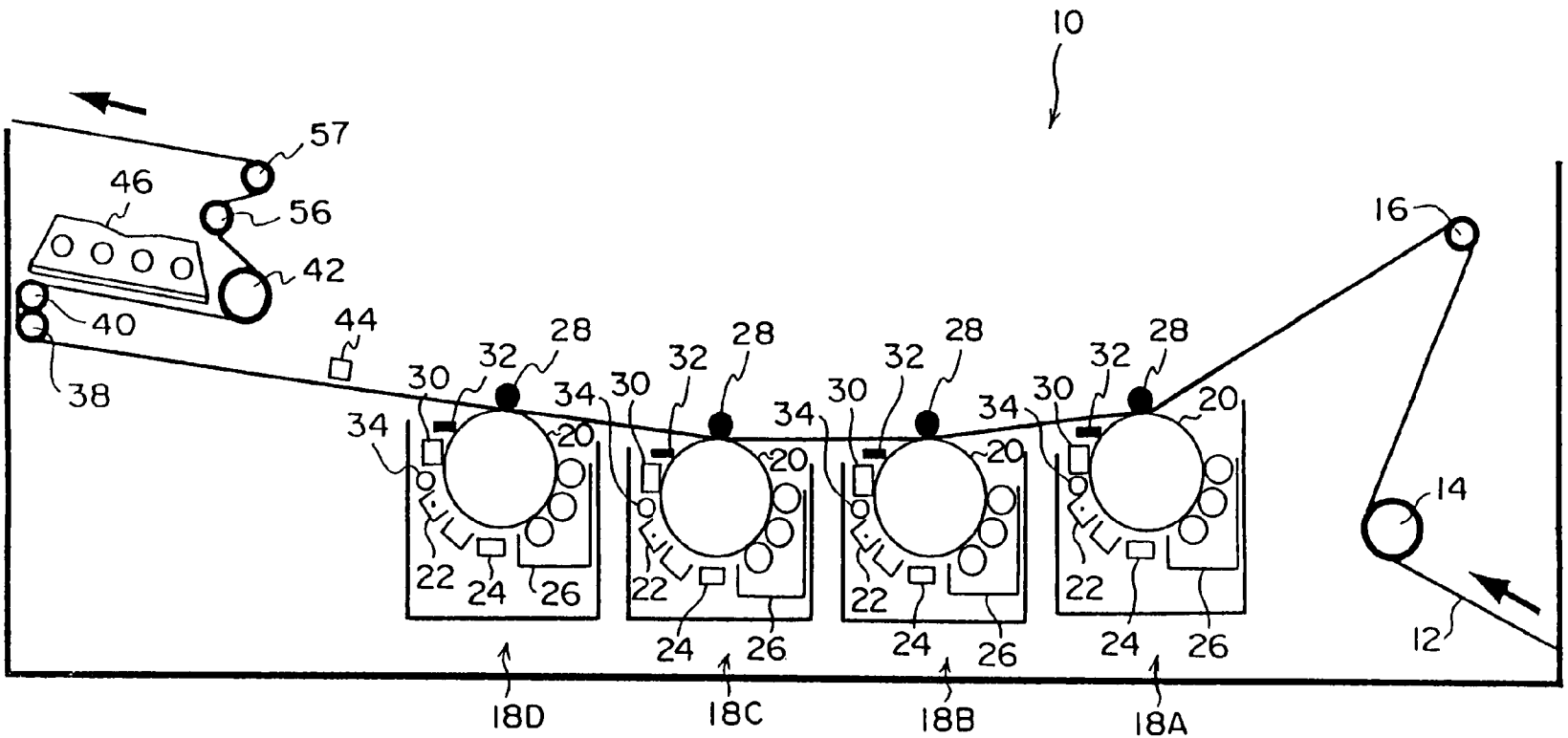
FIG. 1 is a schematic structural diagram of a color image forming device relating to the embodiments.

A color image forming device 10 relating to the embodiments is shown in FIG. 1. The color image forming device 10 is a device which forms color images on a recording medium 12 which is formed from a continuous sheet in which perforations for severing are formed in advance. The recording medium 12, which is inserted into the machine body of the color image forming device 10, is wrapped around wrap rollers 14, 16, and is conveyed at a constant speed along a conveying path which is formed so as to traverse the interior of the machine body. Image forming sections 18A, 18B, 18C, 18D, which form toner images of the respective colors of C (cyan), M (magenta), Y (yellow), and K (black), are disposed beneath the conveying path of the recording medium 12 at substantially uniform intervals along the conveying path.

The image forming sections 18A through 18D are structured the same, other than in respect of the colors of the toner images which they form. Each of the image forming sections 18A through 18D has a photosensitive drum 20 disposed such that its axis is orthogonal to the conveying direction of the recording medium 12. The image forming sections 18A through 18D are each structured such that, at the periphery of the photosensitive drum 20, there are disposed: a charger 22, for charging the photosensitive drum 20; an exposure head 24, which irradiates a light beam onto the charged photosensitive drum 20 and forms an electrostatic latent image thereon; a developing device 26, which supplies toner of a predetermined color to the region on the photosensitive drum 20 where the electrostatic latent image is formed and develops the electrostatic latent image, thereby forming a toner image of the predetermined color on the photosensitive drum 20; a transfer device 28, disposed so as to oppose the photosensitive drum 20 with the recording medium 12 conveying path therebetween; a charge removing device 30, removing the charge of the photosensitive drum 20; and a cleaner blade 32 and cleaner brush 34 for removing the residual toner on the photosensitive drum 20.

After the image forming sections 18A through 18D form toner images of respectively different colors on the peripheral surfaces of the photosensitive drums 20 by the chargers 22, the exposure heads 24, and the developing devices 26, the image forming sections 18A through 18D transfer the formed toner images onto the recording medium 12 by the transfer devices 28. The execution timings of the series of processes of charging, exposure (electrostatic latent image formation), developing (toner image formation), and transfer at each of the image forming sections 18A through 18D, are controlled such that the toner images formed at the respective image forming sections 18A through 18D are superposed one on the other on the recording medium 12. In this way, a full-color toner image is formed on the recording medium 12. Note that a positional offset correcting device is mounted to the exposure head 24 of each of the image forming sections 18A through 18D, and a charging wire cleaning device is mounted to the charger 22 of each of the image forming sections 18A through 18D. These positional offset correcting devices and charging wire cleaning devices will be described in detail later.

At the conveying path of the recording medium 12, the conveying direction is reversed by wrap rollers 38, 40 at the downstream side of the positions where the image forming sections 18A through 18D are disposed. At the section between the wrap roller 40 and a wrap roller 42 of the final stage, the recording medium 12 is conveyed at a downward incline at an angle which is near horizontal. A registration sensor 44, which is for detecting the positions of registration marks (to be described in detail later) formed on the recording medium 12, is disposed above the section of the conveying path between the downstream-most image forming section 18D and the wrap roller 38. A flash fixing unit 46 is disposed above the section of the conveying path between the wrap rollers 40, 42. Note that the registration sensor 44 may also be disposed at the downstream side, in the conveying direction of the recording medium 12, of the flash fixing unit 46.

As shown in FIG. 2A as well, the flash fixing unit 46 has a group of four main flash lamps 48A through 48D which emit flash light for supplying energy which fixes the toner image (fuses the toner) transferred on the recording medium 12. The group of main flash lamps 48A through 48D have the same diameters, and are oriented such that the longitudinal directions thereof run along the transverse direction of the recording medium 12 (the direction orthogonal to the conveying direction of the recording medium 12), and are disposed at uniform intervals along the conveying direction of the recording medium 12. An auxiliary flash lamp 54, whose diameter is smaller than that of the group of main flash lamps 48A through 48D, is disposed parallel to the group of main flash lamps 48A through 48D, at a position which is at the center of the positions where the main flash lamps 48B, 48C are disposed and which is offset slightly downward from the arrangement of the group of main flash lamps 48A through 48D (closer to the recording medium 12 than). Note that the group of main flash lamps 48A through 48D corresponds to the group of main flash lamps relating to the present invention, and the auxiliary flash lamp 54 corresponds to the auxiliary flash lamp relating to the present invention.

A reflecting plate 50 is provided at the reverse surface side of the group of main flash lamps 48A through 48D and the auxiliary flash lamp 54, as seen from the recording medium 12 conveying path side. The reflecting plate 50 is a configuration which envelops the reverse surface side of the flash lamps 48A through 48D, 54 and in whose front surface side (conveying path side) an opening is formed. The reflecting plate 50 reflects the flash light, which exits from the flash lamps toward the reverse surface side, toward the conveying path side. In the present embodiment, the main flash lamps 48A through 48D of the group are made to emit light simultaneously. The configuration and the like of the reflecting plate 50 are adjusted such that, when the group of main flash lamps 48A through 48D emit light simultaneously, the flash light which is illuminated onto the recording medium 12 is a substantially uniform light amount (=energy) over substantially the entire surface of the illumination range. Further, a cover glass 52 is disposed at the front surface side (the conveying path side) of the flash lamps 48A through 48D, 54. The cover glass 52 is provided so as to close the opening of the reflecting plate 50. The entry of dust and the like into the flash fixing unit 46 is impeded by the cover glass 52.

Figure 3:
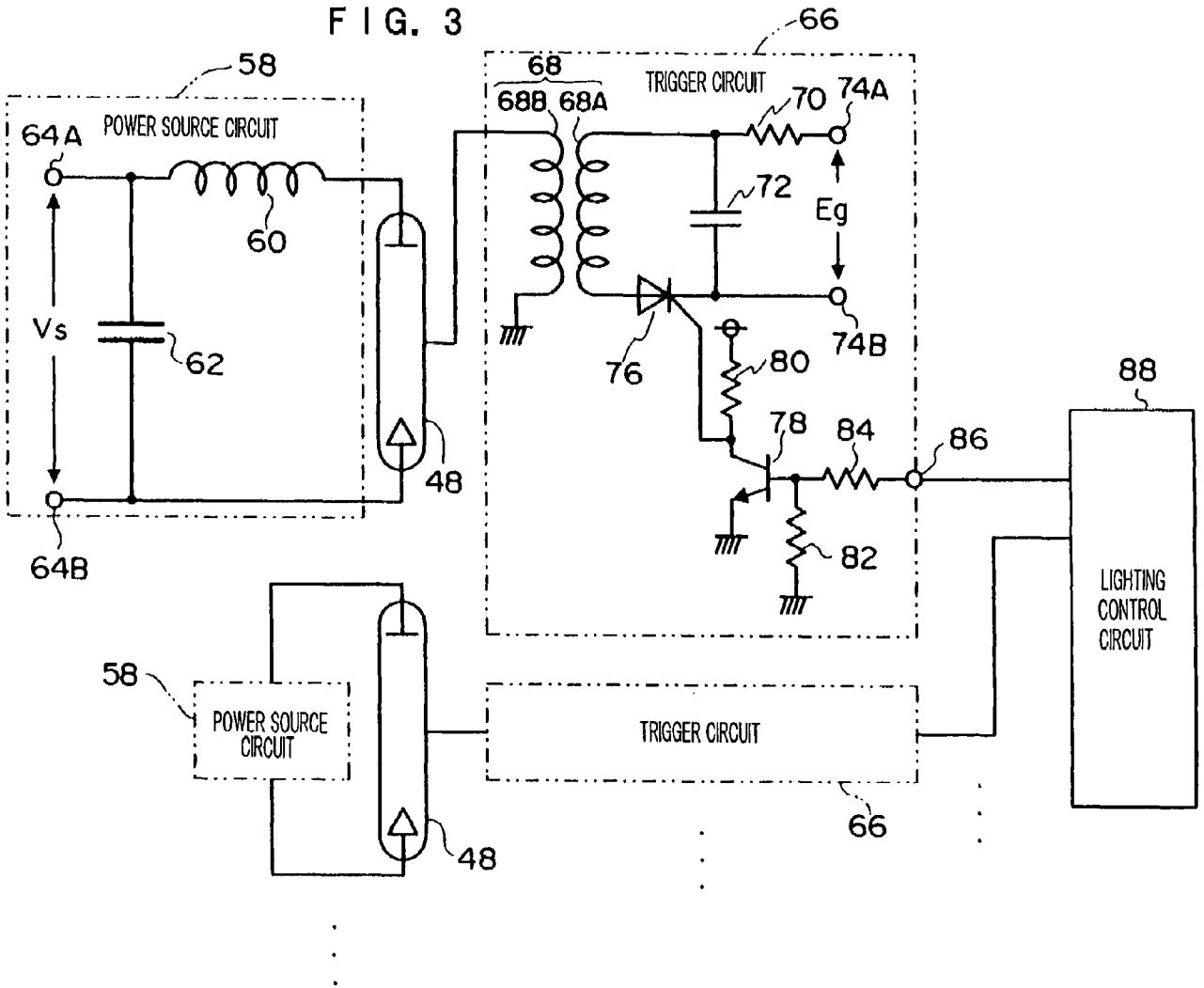
FIG. 3 is a schematic structural diagram of a flash lamp driving system.

As shown in FIG. 3, both ends of each main flash lamp 48 of the flash fixing unit 46 are connected to a power source circuit 58. Namely, one end of the main flash lamp 48 is connected to a power source terminal 64B, whereas the other end of the lamp 48 is connected to one end of a choke coil 60. The other end of the choke coil 60 is connected to a power source terminal 64A and one end of a capacitor 62. The other end of the capacitor 62 is connected to the power source terminal 64B. DC voltage Vs, generated, for example, by commercial AC voltage being rectified and boosted, is supplied to the power source terminals 64A, 64B, and in doing so the capacitor 62 is charged by the DC voltage Vs, and the electrostatic energy which is accumulated is supplied to the main flash lamp 48 at the time when the main flash lamp 48 emits light.

The trigger electrode of the main flash lamp 48 is connected to a trigger circuit 66. The trigger circuit 66 has a transformer 68. The trigger electrode of the main flash lamp 48 is connected to the other end of a secondary side coil 68B of the transformer 68, whose one end is grounded. Further, one end of a primary side coil 68A of the transformer 68 is connected to one end of a resistor 70 and one end of a capacitor 72. The other end of the resistor 70 is connected to a power source terminal 74A. The other end of the primary side coil 68A is connected to one end of a thyristor 76, and the other end of the thyristor 76 is connected to the other end of the capacitor 72 and a power source terminal 74B. When the capacitor 72 is charged by DC voltage Eg which is supplied via the power source terminals 74A, 74B and the thyristor 76 becomes continuous, the accumulated electrostatic energy is supplied to the trigger electrode of the main flash lamp 48 via the transformer 68, and the main flash lamp 48 is thereby made to emit light.

The gate of the thyristor 76 is connected to the collector of a transistor 78. The collector of the transistor 78 is connected to a power supply wire via a resistor 80, and the emitter thereof is grounded. The base of the transistor 78 is connected to the other end of a resistor 82 whose one end is grounded, and is connected to a control signal input end 86 via a resistor 84. The control signal input end 86 is connected to a lighting control circuit 88 which is structured so as to include a microcomputer or the like. The lighting control circuit 88 supplies, to the trigger circuit 66 via the control signal input end 86, a control signal which is high-level during the time when the main flash lamp 48 is extinguished, and which switches to low-level when the main flash lamp 48 is lit. During the period of time when the control signal is low-level, due to the transistor 78 being off, the thyristor 76 is continuous, and the electrostatic energy accumulated in the capacitor 72 is supplied to the trigger electrode of the main flash lamp 48 via the transformer 68, and the main flash lamp 48 is thereby made to emit light.

The above-described power source circuit 58 and trigger circuit 66 are connected to each of the main flash lamps 48A through 48D in the group of the flash fixing unit 46. The power source circuit 58 and the trigger circuit 66 are connected to the auxiliary flash lamp 54 as well. However, in the present embodiment, by making the electrostatic capacity of the capacitor 62 of the power source circuit 58 which is connected to the auxiliary flash lamp 54 smaller than those of the power source circuits 58 connected to the main flash lamps 48, the light amount (=energy) of the flash light illuminated onto the recording medium 12 as the auxiliary flash lamp 54 emits light is adjusted so as to be smaller than those of the individual main flash lamps 48. Further, the trigger circuits 66 connected to the group of main flash lamps 48A through 48D and the auxiliary flash lamp 54 are respectively controlled by the lighting control circuit 88. The lighting control circuit 88 controls the lighting and extinguishing of each of the group of main flash lamps 48A through 48D and the auxiliary flash lamp 54.

Note that the flash fixing unit 46, the power source circuits 58 and trigger circuits 66 are connected to the individual flash lamps 48A through 48D, 54, and the lighting control circuit 88 correspond to the flash fixing device relating to the present invention. The power source circuits 58, the trigger circuits 66, and the lighting control circuit 88 correspond to the light-emission control unit relating to the present invention.

On the other hand, wrap rollers 56, 57 are disposed in that order at the stage after the wrap roller 42. The recording medium 12, on which the toner image has been fixed due to flash light being illuminated from the flash fixing unit 46, is guided by the wrap rollers 56, 57 and discharged to the exterior of the machine body of the color image forming device 10. Note that the color image forming device 10 relating to the present embodiment is structured so as to record color images onto only one surface of the recording medium 12. However, recording of color images onto both sides of the recording medium 12 is also possible if two of the color image forming devices 10 relating to the present embodiment are provided, a reversing device which reverses the obverse and reverse of the recording medium 12 is provided, and the two color image forming devices 10 and the reversing device are disposed such that the recording medium 12, on only one surface of which a color image has been recorded by the first color image forming device 10 and which has been discharged-out, is, after the obverse and reverse thereof are reversed by the reversing device, fed-into the machine body of the second color image forming device 10.

Figure 4:
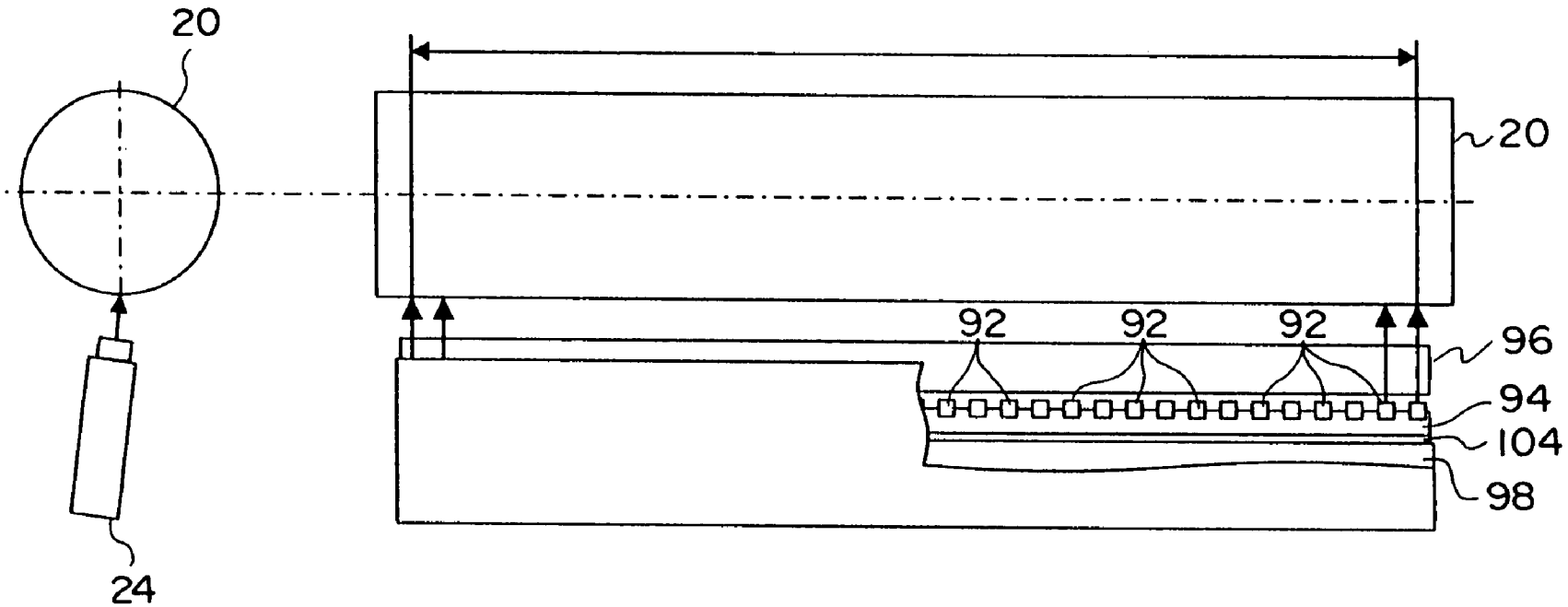
FIG. 4 is a front view and a side view showing an exposure head and a photosensitive drum, with the exposure head partially cut-away.

Next, the structure of the positional offset correcting device which is mounted to the exposure head 24 of each of the image forming sections 18A through 18D will be described. As shown in FIG. 4, the exposure head 24 of each of the image forming sections 18A through 18D has a large number of LEDs 92 serving as the exposure light source. The large number of LEDs 92 are affixed to one surface (the obverse) of a substrate 94, whose overall shape is substantially elongated, at uniform intervals along the longitudinal direction of the substrate 94. The exposure head 24 is disposed, with an interval between the exposure head 24 and the photosensitive drum 20, such that the direction in which the LEDs 92 are lined-up (the longitudinal direction of the substrate 94) is parallel to the axis of the photosensitive drum 20 (the main scanning direction of the electrostatic latent image to be formed on the peripheral surface of the photosensitive drum 20). Further, a SELFOC lens array 96, which is supported by unillustrated brackets, is disposed at the light beam exiting side of the LEDs 92. The light beams exiting from the individual LEDs 92 pass-through the SELFOC lens array 96, and are illuminated onto respectively different positions on the peripheral surface of the photosensitive drum 20.

A base member 98, which is formed of a metal having high thermal conductivity (e.g., aluminum), is disposed at the side of the substrate 94 that is the opposite surface to that at which the LEDs 92 are affixed (i.e., is disposed at the reverse side of the substrate 94). The substrate 94 is mounted to the base member 98 by plural screws. Although holes for passage of the screws are formed in plural places of the substrate 94, among these plural holes, only the single hole which is formed at the longitudinal direction center of the substrate 94 is a circular hole, and the holes formed in the other places are elongated holes whose long axis directions coincide with the longitudinal direction of the substrate 94 (not illustrated). In this way, if the temperature of the substrate 94 changes and the longitudinal direction dimension of the substrate 94 extends and contracts, the width of the exposure range by the large number of LEDs 92 (hereinafter called "printing width") fluctuates with the longitudinal direction center of the substrate 94 being the reference. Note that the position of the circular hole is not limited to the longitudinal direction center of the substrate 94, and it is possible for only a hole formed in one longitudinal direction end of the substrate 94 to be the circular hole. In this case, as the longitudinal direction dimension of the substrate 94 extends and contracts, the printing width fluctuates with the one longitudinal direction end of the substrate 94 as a reference.

Figure 5A:
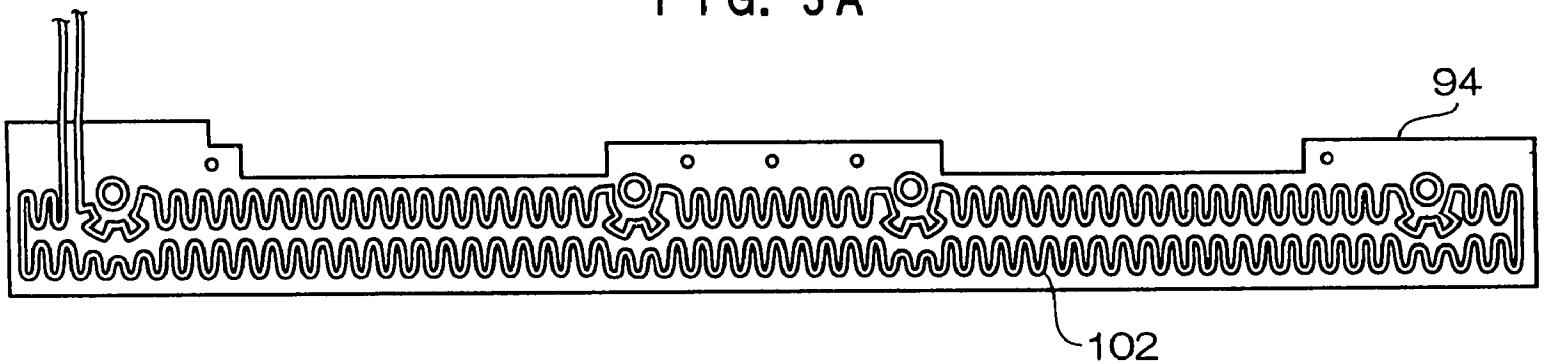
FIG. 5A is a plan view showing an example of a wiring pattern of a resistor element serving as a heater.
Figure 5B:
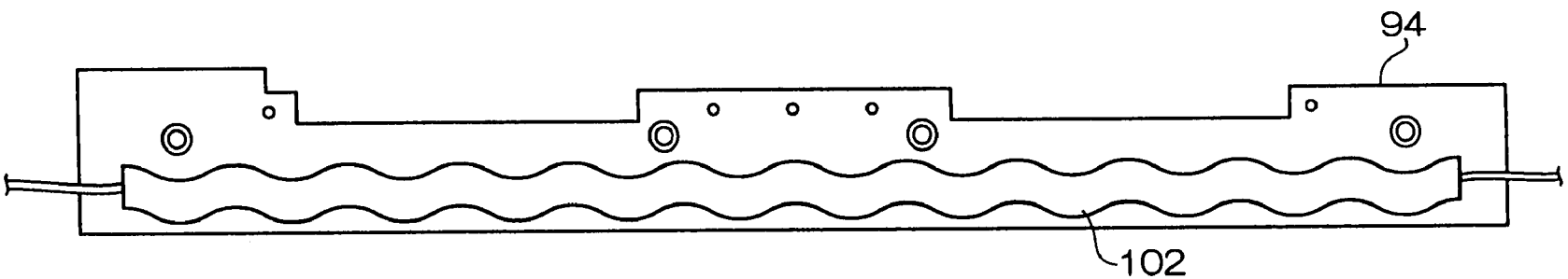
FIG. 5B is a plan view showing another example of a wiring pattern of the resistor element serving as the heater.

A heater 100 (heating means, see FIG. 6) for heating the substrate 94 is incorporated in the exposure head 24 relating to the present embodiment. The heater 100 relating to the present embodiment is structured by a wiring pattern 102 of a resistor element such as shown in FIG. 5A or FIG. 5B being formed on the reverse surface of the substrate 94. Due to the heater 100 heating the substrate 94, the printing width of the exposure head 24 varies, as shown, for example, in FIG. 7 with respect to changes in the output of the heater 100. (In FIG. 7, the amount of change in the printing width is denoted as the correction amount.) Further, a sheet material 104 (see FIG. 4), which is electrically insulating and thermally conductive, is interposed between the substrate 94 and the base member 98. In this way, the sheet material 104 impedes leaking, to the base member 98, of the current which is flowing through the wiring pattern 102 of the resistor element. Moreover, due to the substrate 94 contacting the base member 98 via the sheet material 104, it is also possible to prevent the temperature of the substrate 94 from becoming excessively high, and prevent unevenness of temperature from arising.

The wiring pattern shown in FIG. 5A is advantageous with respect to the routing of the wiring, because the two wires are connected to the heater 100 (the wiring pattern 102 of the resistor element) at one longitudinal direction end side of the substrate 94. However, since the wiring pattern 102 of the resistor element must be laid back-and-forth on the reverse surface of the substrate 94 in order to substantially uniformly heat the entire surface of the substrate 94, there therefore is the drawback that, due to the wiring pattern 102 of the resistor element being long and thin, it is easy for the electrical resistance value of the resistor element overall to become high, and the output of the heater 100 becomes small. In contrast therewith, the wiring pattern shown in FIG. 5B is disadvantageous with regard to the routing of the wiring, because wires are connected to both the longitudinal direction ends of the substrate 94. However, there is no need to lay the wiring pattern 102 of the resistor element back-and-forth on the reverse surface of the substrate 94, and by making the wiring pattern 102 of the resistor element short and thick, the electrical resistance value of the resistor element overall can be made to be low and the heater 100 can be made to have a high-output. Therefore, the wiring pattern shown in FIG. 5B is preferable.

Figure 6:
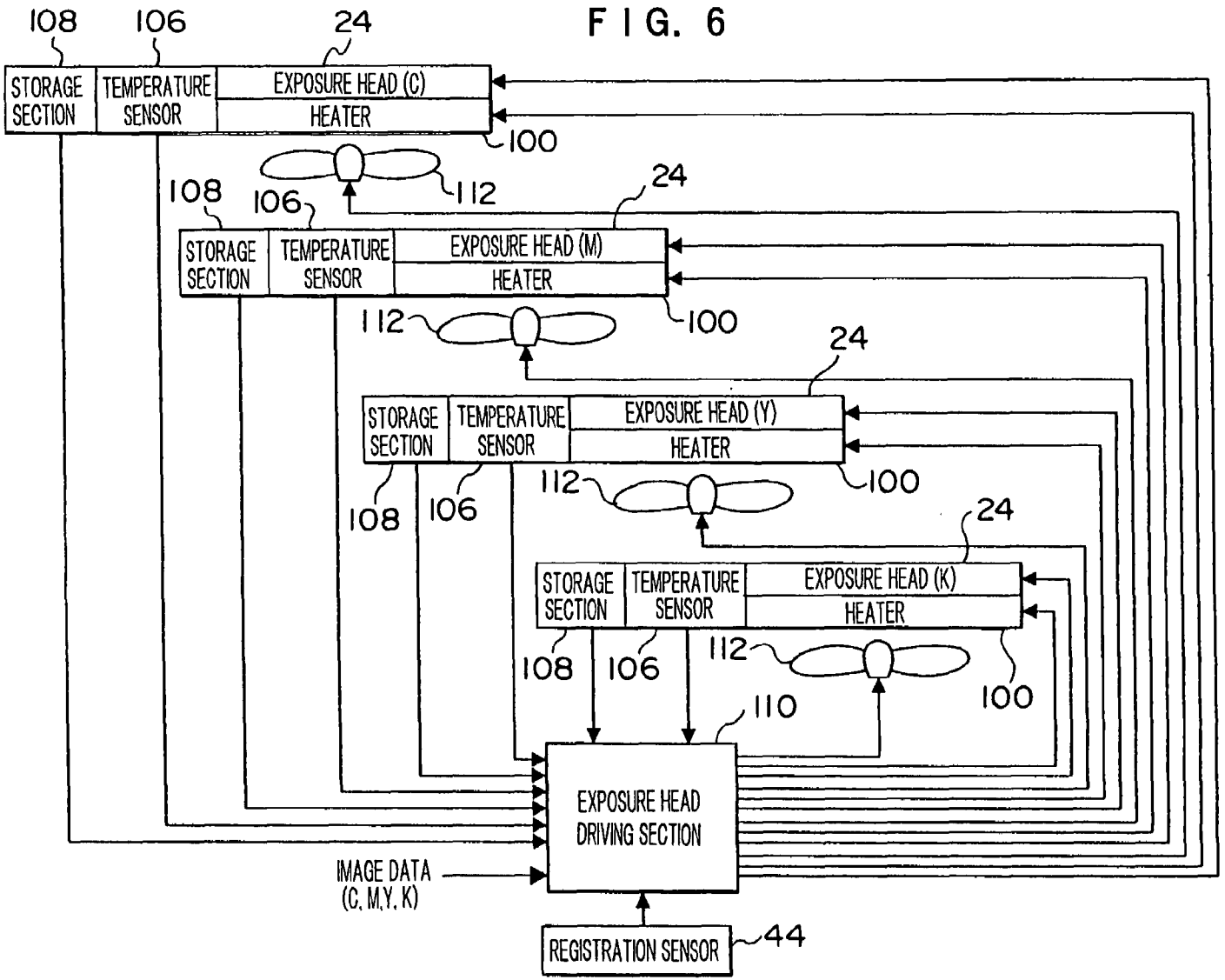
FIG. 6 is a block diagram showing the schematic structure of a positional offset correcting device.

As shown in FIG. 6, a temperature sensor 106 (temperature detecting means) which detects the temperature of the substrate 94, and a storage section 108 structured by a ROM or the like, are added to the exposure head 24 of each image forming section 18A through 18D. A blower fan 112 (cooling means), which supplies a flow of air toward the exposure head 24, is provided in the vicinity of the position of each exposure head 24. There are manufacturing differences in the longitudinal direction sizes of the substrates 94 of the exposure heads 24, and accompanying this, there is also differences in the printing widths of the individual exposure heads 24 (e.g., about ±75 μm). In the present embodiment, at the time of manufacturing the color image forming device 10, the printing widths of the individual exposure heads 24 are measured under a uniform environment, and the measured printing widths are recorded in advance as initial values of the printing widths in each of the storage sections 108 attached to the individual exposure heads 24.

The positional offset correcting device has an exposure head driving section 110 (temperature controlling means) structured by a microcomputer or the like. The exposure head driving section 110 is connected to the respective LEDs 92 of the exposure heads 24 of the image forming sections 18A through 18D. When image data, which expresses the image to be recorded on the recording medium 12, is inputted for each color of C, M, Y, K, the exposure head driving section 110 controls the lighting and extinguishing of the individual LEDs 92 of the exposure heads 24 on the basis of the inputted image data of the respective colors, and thereby causes toner images of the respective colors, which correspond to the inputted image data of the respective colors, to be formed on the photosensitive drums 20 of the image forming sections 18A through 18D.

Figure 7:
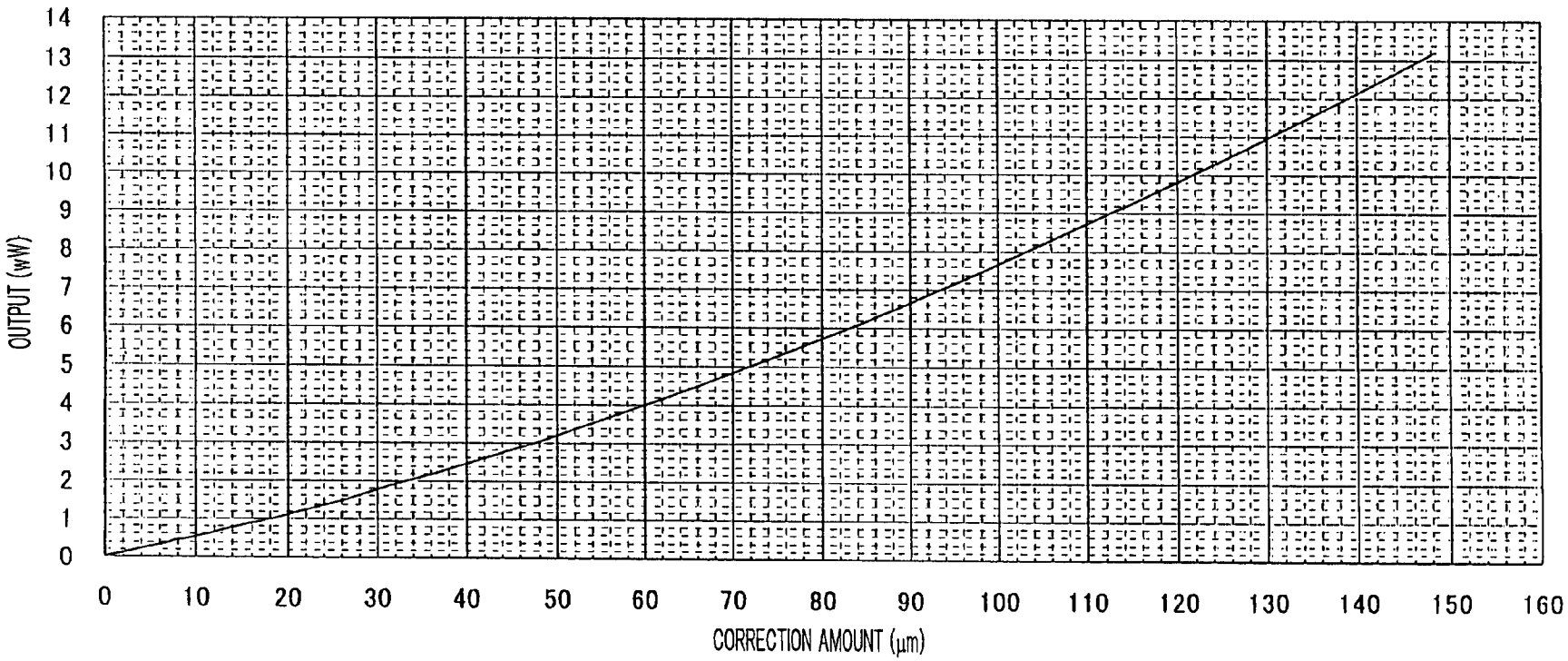
FIG. 7 is a graph showing an example of the relationship between heater output and an amount of positional offset (correction amount)

The heaters 100 which are incorporated in the exposure heads 24, and the blower fans 112 which are provided in vicinities of the positions of the exposure heads 24, are connected to the exposure head driving section 110. The temperature sensors 106 and the storage sections 108 added to the individual exposure heads 24 are also connected to the exposure head driving section 110. Further, the registration sensor 44 is connected to the exposure head driving section 110. The relationship, such as shown in FIG. 7 as an example, between the output of the heater 100 and the amount of change in the printing width of the exposure head 24 (denoted as "correction amount" in FIG. 7) is stored in a storage section which is incorporated in the exposure head driving section 110. On the basis of the temperatures of the substrates 94 of the exposure heads 24 detected by the temperature sensors 106, and the initial values of the printing widths of the exposure heads 24 stored in the storage sections 108, and the positions of registration marks detected by the registration sensor 44, the exposure head driving section 110 controls the heaters 100 incorporated in the individual exposure heads 24 such that the printing widths of the individual exposure heads 24 become equal to one another. (Details of this control will be described later.)

Figure 8:
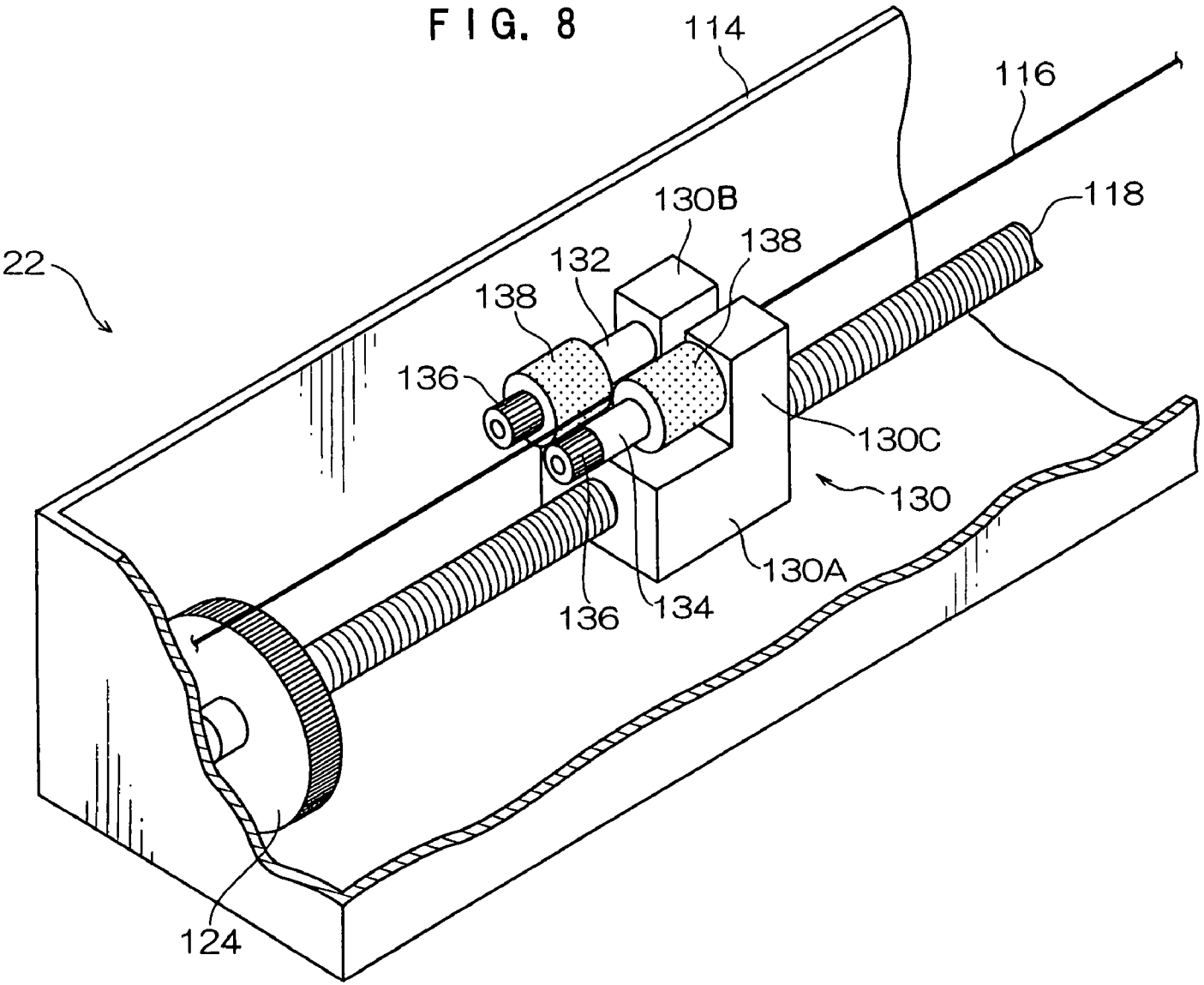
FIG. 8 is a perspective view showing a charger to which a cleaning device is mounted, with the charger partially cut-away.

Next, explanation will be given of the structures of the charging wire cleaning devices which are mounted to the chargers 22 of the image forming sections 18A through 18D. As shown in FIG. 8, the charger 22 has a casing 114 which is formed in the shape of a long, thin box, and which is disposed with a gap between the casing 114 and the photosensitive drum 20 such that longitudinal direction of the casing 114 is parallel to the axis of the photosensitive drum 20. The plane of the casing 114 which opposes the photosensitive drum 20 is open. A charging wire 116, which extends parallel to the axis of the photosensitive drum 20, spans the interior of the casing 114.

Figure 10:
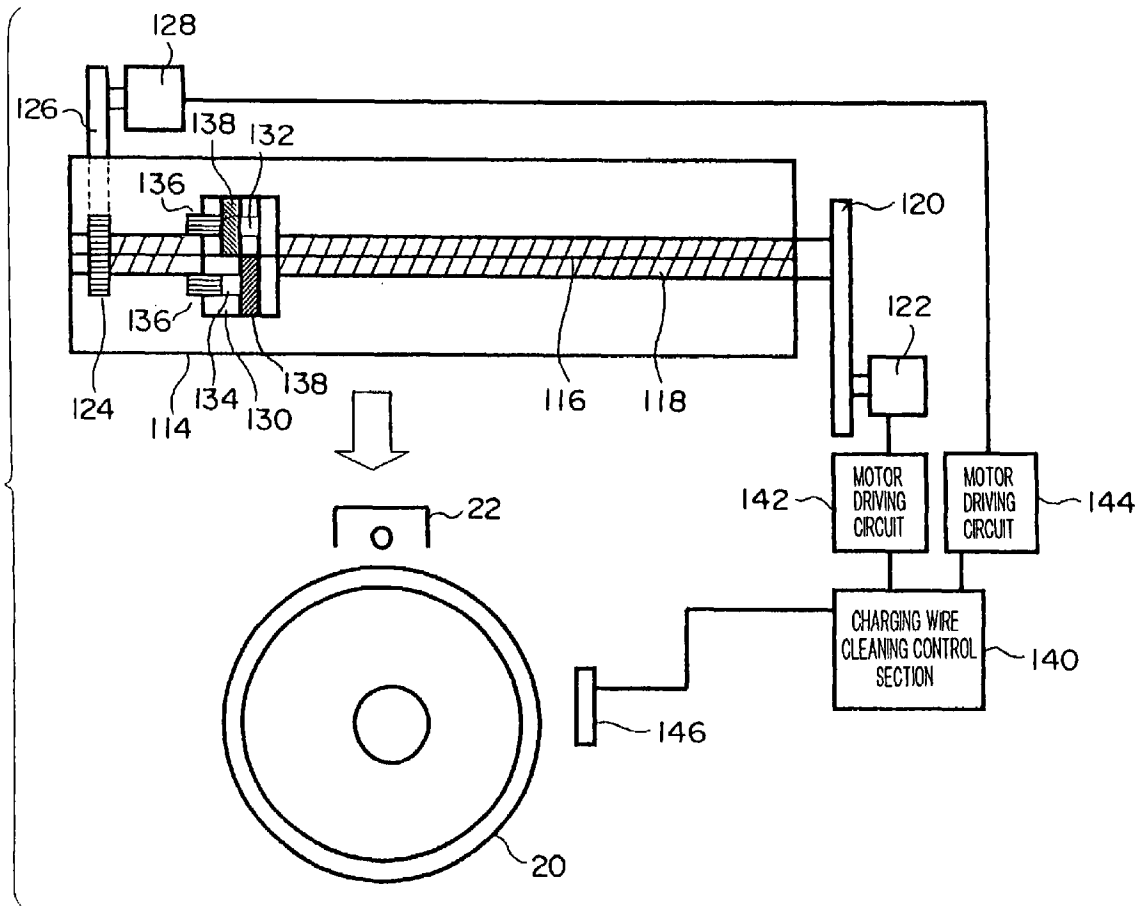
FIG. 10 is a schematic structural diagram of the cleaning device.

The charging wire cleaning device has a screw shaft 118 (moving means) which spans the interior of the casing 114, parallel to the charging wire 116. The screw shaft 118 is disposed at the side of the charging wire 116 opposite to the side at which the photosensitive drum 20 is located, and is rotatably supported by the casing 114. As shown in FIG. 10, one end of the screw shaft 118 passes through the casing 114 and projects-out from the casing 114. The distal end portion at the one end side of the screw shaft 118 is connected to the rotating shaft of a motor 122 (moving means) (a stepping motor is suitable as the motor 122) via a driving force transferring mechanism 120 (moving means) (a belt or a gear may be used therefor). Accordingly, when the motor 122 is driven, the driving force of the motor 122 is transferred to the screw shaft 118 via the driving force transferring mechanism 120, and the screw shaft 118 is driven and rotated.

A gear 124 (rotating means) which is coaxial with the screw shaft 118 is disposed within the casing 114 in a vicinity of the end portion of the screw shaft 118 at the side opposite the side at which the driving force transferring mechanism 120 is connected. The gear 124 is supported by the screw shaft 118 so as to be able to rotate with respect to the screw shaft 118 (see FIG. 8 as well). The gear 124 is connected to the rotating shaft of a motor 128 (rotating means) (a stepping motor is suitable for the motor 128 as well) via a driving force transferring mechanism 126 (rotating means) (a belt or a gear may also be used for this driving force transferring mechanism 126). Accordingly, when the motor 128 is driven, the driving force of the motor 128 is transferred to the gear 124 via the driving force transferring mechanism 126, and the gear 124 is driven and rotated with respect to the screw shaft 118.

As shown in FIG. 8, the charging wire cleaning device has a cleaning pad carrier 130 (moving means). The cleaning pad carrier 130 is substantially L-shaped. A female screw hole is formed in a base portion 130A, which corresponds to the bottom side of the "L", and the screw shaft 118 is screwed therein. In this way, a ball screw is structured by the screw shaft 118 and the cleaning pad carrier 130. When the screw shaft 118 is rotated, the cleaning pad carrier 130 is moved along the screw shaft 118 (the charging wire 116) in a direction corresponding to the direction of rotation of the screw shaft 118. Further, the erect portion of the cleaning pad carrier 130, which stands erect from the base portion 130A, is divided into a first erect portion 130B and a second erect portion 130C by a groove which is provided in order to avoid contact with the charging wire 116. The erect portions 130B, 130C rotatably support one end of rotating shafts 132, 134, which are disposed parallel to the charging wire 116.

Figure 11A:
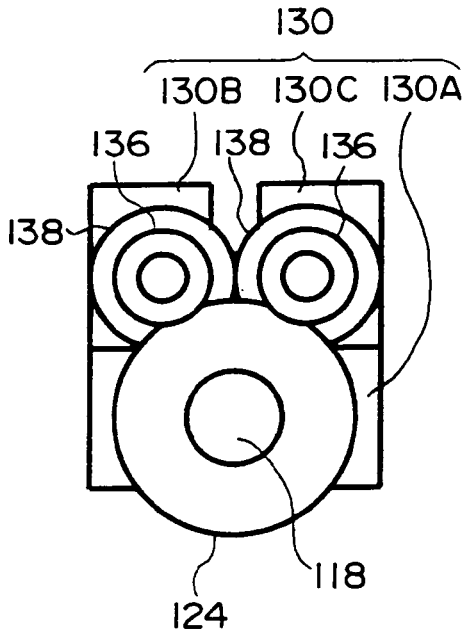
FIG. 11A is a front view showing a state in which gears of rotating shafts are meshed together with a gear of a screw shaft.
Figure 11B:
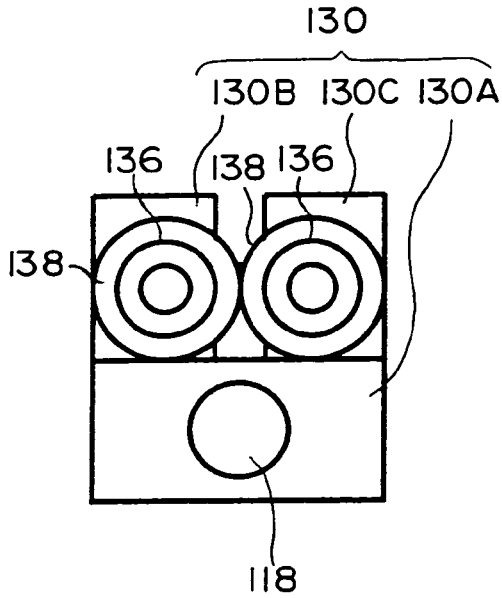
FIG. 11B is a front view showing a state in which they are not meshed together.

Gears 136 (rotating means), which mesh together with the gear 124 in the state in which the cleaning pad carrier 130 has been moved toward the gear 124 side, are formed at the distal ends of the rotating shafts 132, 134. Note that the gear 124 side end portions of the gears 136 are machined so as to reliably mesh-together with the gear 124 at the time when the cleaning pad carrier 130 has been moved to the gear 124 side. When the motor 128 is driven in the state in which the gears 136 mesh-together with the gear 124 (see FIG. 11A) (the non-meshed state is shown in FIG. 111B), the rotating shafts 132, 134 are also driven and rotated together with the gears 136. Cylindrical-tube-shaped cleaning pads 138 are mounted to the intermediate portions of the rotating shafts 132, 134, at positions which are different from one another along the axes of the rotating shafts 132, 134.

Figure 9B:
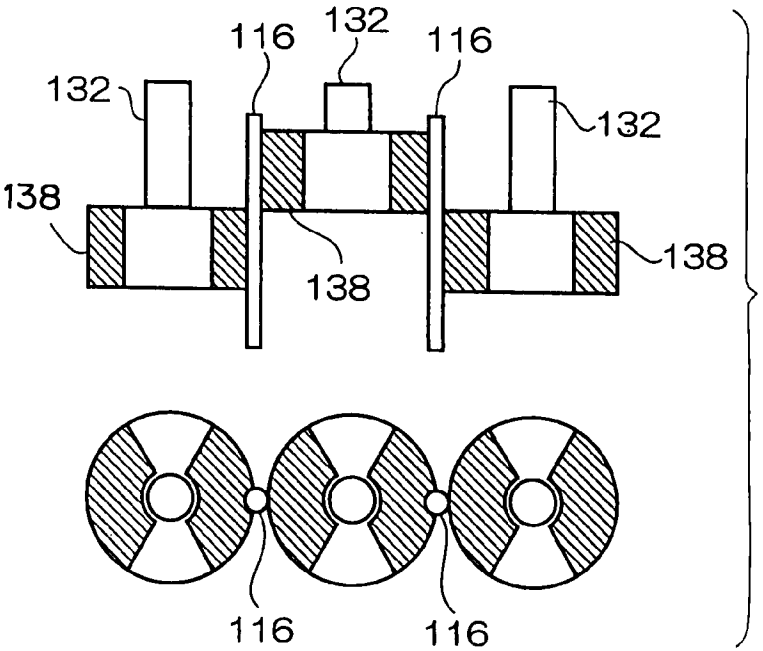
FIG. 9B (above) is a top view, and FIG. 9B (below) is a front view showing an example of the cleaning pads.
Figure 9A:
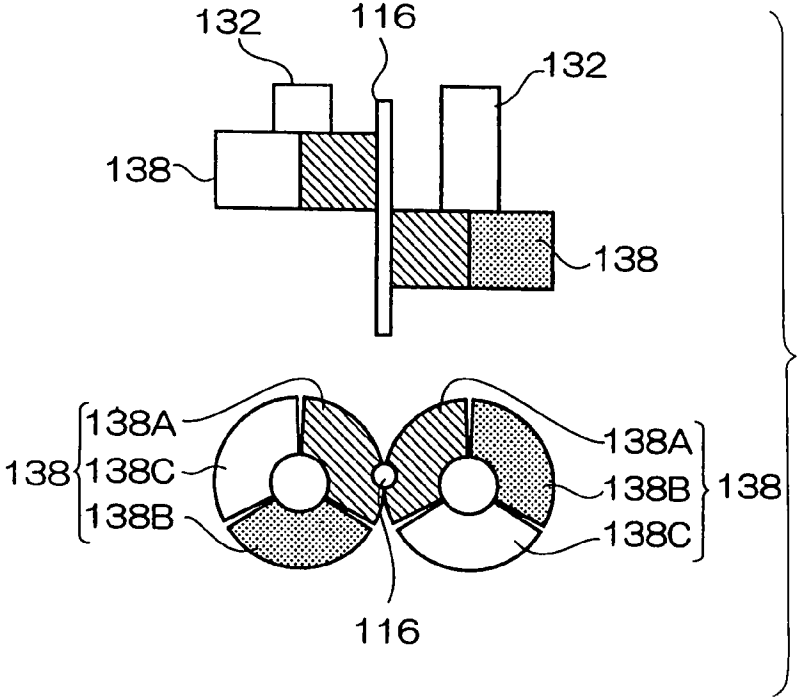
FIG. 9A (above) is a top view, and FIG. 9A (below) is a front view, showing an example of cleaning pads.

As shown in FIG. 9A, the cleaning pad 138 is structured by three types of pads 138A through 138C, whose roughnesses and materials are respectively different, being disposed along the peripheral direction. The positions of the rotating shafts 132, 134 with respect to the charging wire 116 are adjusted so that the outer peripheral surface of the cleaning pad 138 (one of the pads 138A through 138C) contact the charging wire 116. Accordingly, when the screw shaft 118 is rotated and the cleaning pad carrier 130 is moved along the screw shaft 118, the cleaning pads 138 are slid along the charging wire 116 while the state in which the cleaning pads 138 contact the charging wire 116 is maintained. The cleaning wire 116 is thereby cleaned. Note that, although not illustrated, a braking mechanism is incorporated in each of the erect portions 130B, 130C of the cleaning pad carrier 130. The braking mechanisms apply a uniform braking force with respect to the rotation of the rotating shafts 132, 134, by, for example, pushing friction members against the outer peripheral surfaces of the rotating shafts 132, 134 by the urging forces of urging means such as springs or the like, or the like. Due to the braking mechanisms, the cleaning pads 138 are prevented from rotating during the time when the cleaning pads 138 are sliding along the charging wire 116.

The cleaning pads 138 rotate integrally with the rotating shafts 132, 134. Therefore, in the state in which the cleaning pad carrier 130 has moved to the position at which the gears 136 mesh-together with the gear 124, and the gears 136 are meshing-together with the gear 124, when the motor 128 is driven and the rotating shafts 132, 134 are driven and rotated, the cleaning pads 138 also rotate together with the rotating shafts 132, 134. Due to the rotation of the cleaning pads 138, the positions of the portions of the outer peripheral surfaces of the cleaning pads 138, the portions contacting the charging wire 116, change, and different pads from before among the pads 138A through 138C, contact the charging wire 116.

As shown in FIG. 10, the charging wire cleaning device has a charging wire cleaning control section 140 (cleaning control means) which is formed from a microcomputer or the like. The motors 122, 128 are connected to the charging wire cleaning control section 140 via motor driving circuits 142, 144. The charging wire cleaning control section 140 controls the driving of the motors 122, 128 via the motor driving circuits 142, 144. Note that the motor driving circuit 142 which drives the motor 122 also functions so as to detect the driving current flowing through the motor 122 at the time when the motor 122 is driven (as a sensing means). Further, a surface potential sensor 146 (sensing means), which detects the surface potential of the photosensitive drum 20, is provided at the outer peripheral side of the photosensitive drum 20. This surface potential sensor 146 also is connected to the charging wire cleaning control section 140.

Next, operation of the flash fixing device will be described first, as an operation of the present embodiment. When recording of an image onto the recording medium 12 is started at the color image forming device 10, the lighting control circuit 88 outputs control signals to the trigger circuits 66 connected to the group of main flash lamps 48A through 48D, so that the group of main flash lamps 48A through 48D emit light intermittently at the light-emission period T, as shown in FIG. 2B, as an example.

The light distribution pattern of the main flash light, which is illuminated onto the recording medium 12 as the group of main flash lamps 48A through 48D emit light, is, as shown in FIG. 2C as well, a pattern in which the amount of illuminated light of the flash light is substantially uniform at the central portion along the recording medium 12 conveying direction, but, in vicinities of the both end portions along the recording medium 12 conveying direction, the further away from the central portion, the more the amount of illuminated light of the flash light gently decreases. Therefore, the light-emission period T of the group of main flash lamps 48A through 48D is determined such that, at regions (repeat regions) of the recording medium 12 which are illuminated by flash light of the low light amount portions (the vicinities of the both end portions) of the light distribution pattern of the main flash light, flash light of a low light amount portion is illuminated two times. This can be realized by, for example, setting the light-emission period T to be $T=(W-D)/v$, where v is the conveying speed of the recording medium 12, W is the opening width of the flash fixing unit 46, and D is the length, along the conveying direction of the recording medium 12, of the low light amount portion in the light distribution pattern of the main flash light.

Further, the lighting control circuit 88 outputs a control signal to the trigger circuit 66 connected to the auxiliary flash lamp 52, such that the auxiliary flash lamp 54 intermittently emits light at the light-emission period T, at a time which is delayed by (T/2) with respect to the light-emission time of the group of main flash lamps 48A through 48D, as shown as an example in FIG. 2B. This delay time (T/2) corresponds to the time which is needed, from the time that the group of main flash lamps 48A through 48D emit light and the main flash light is illuminated onto the recording medium 12, for the central portion of the region in the light distribution pattern of the main flash light which is illuminated by flash light of a low light amount on the recording medium 12 conveying direction upstream side (i.e., the central portion of the repeat region), to reach a position directly beneath the position where the auxiliary flash lamp 54 is disposed. In this way, as shown in FIG. 2C as well, the auxiliary flash lamp 54 emits light each time that the repeat region on the recording medium 12 corresponds to the illumination position where the auxiliary flash light is illuminated from the auxiliary flash lamp 54. At each repeat region on the recording medium 12, the auxiliary flash light from the auxiliary flash lamp 54 is illuminated one time during the interval between the two times the main flash light of the relatively low light amount is illuminated, giving a total of three illuminations.

Figure 12A:
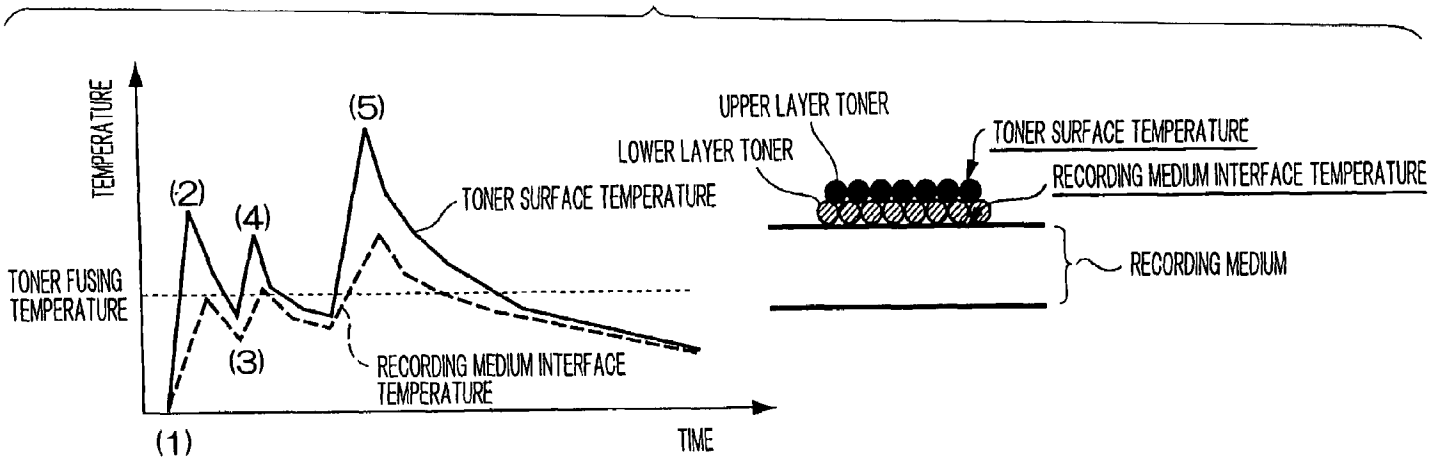
FIG. 12A is a graph showing the progression of temperatures of the toner surface and the recording medium interface in a repeat region, in a case in which the flash fixing unit shown in FIG. 2A is used.
Figure 12B:
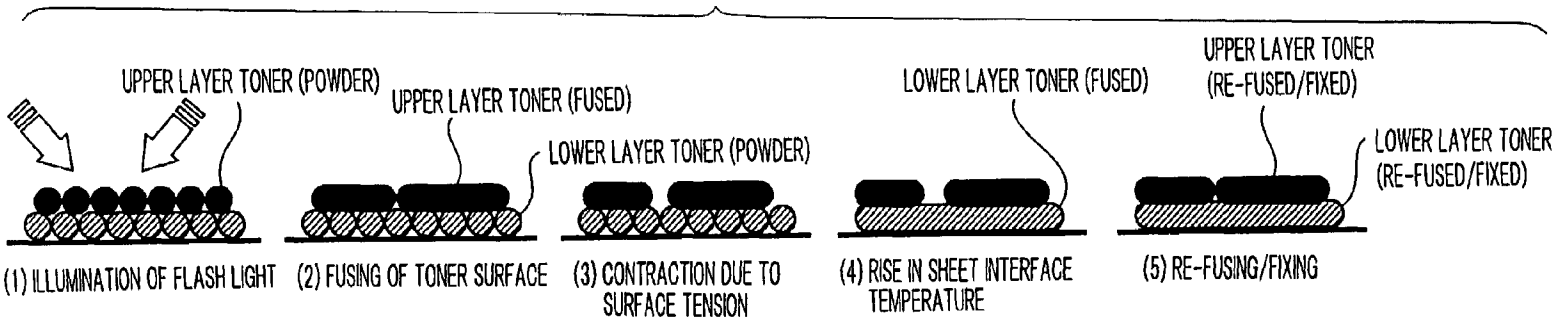
FIG. 12B is a schematic diagram showing the progression of the state of the toner in the repeat region, in the case in which the flash fixing unit shown in FIG. 2A is used.

Due to the flash light illumination three times onto the repeat region on the recording medium 12, the toner surface temperature and the recording medium interface temperature at the repeat region vary as show in FIG. 12A, and the toner in the repeat region is fused and fixed as will be described hereinafter. Namely, as shown in FIG. 12A and by (1) in FIG. 12B, in the stage before flash light is illuminated onto the recording medium 12, all of the toner on the recording medium 12 is in the state of a powder, and the temperature thereof is normal temperature. However, when main flash light of a low light amount is illuminated due to the illumination of the flash light the first time, as shown in FIG. 12A and in (2) of FIG. 12B, the toner of the top layer side of the repeat region fuses due to the surface temperature greatly exceeding the toner fusing temperature (softening), but fusing does not occur at the toner of the lower layer side of the repeat region because the temperature thereof does not reach the toner fusing temperature.

Here, conventionally, during the period of time after the light-emission period T elapses until the time that the flash light is illuminated the second time, the toner of the upper layer side of the repeat region coheres. Due to the temperature of the toner of the upper layer side decreasing greatly, strong surface tension arises at the toner of the upper layer side. Due to the toner of the lower layer side, which is in the state of a powder, also being pulled by this surface tension, deterioration in image quality, such as voids or the like, arises. In contrast, in the present embodiment, after the illumination of flash light the first time, the temperature of the toner of the upper layer side of the repeat region decreases to less than or equal to the toner fusing temperature, and cohesion of the toner of the upper layer side starts (see FIG. 12A and (3) in FIG. 12B), but, after time (T/2) elapses from the first time illumination of the flash light, the auxiliary flash light from the auxiliary flash lamp 54 is illuminated onto the repeat region (see FIG. 12A and (4) in FIG. 12B). Therefore, due to the energy of the auxiliary flash light, the temperature of the toner of the upper layer side of the repeat region again exceeds the toner fusing temperature and the toner fuses, and the interface temperature of the recording medium 12 also exceeds the toner fusing temperature. The toner of the lower layer side of the repeat region thereby also fuses. In this way, falling of the temperature of the toner of the upper layer side of the repeat region during the period of time from the time when the low light amount main flash light is illuminated the first time to the time when the low light amount main flash light is illuminated next, is suppressed. Further, it is possible to prevent image deterioration, such as voids or the like, from being generated due to the toner of the lower layer side, which is in the form of a powder, being pulled due to the strong surface tension which arises at the toner of the upper layer side of the repeat region.

Also after the illumination of the auxiliary flash light (the illumination of flash light the second time), the temperatures of the toner of the upper layer side and the toner of the lower layer side of the repeat region decrease. However, after the time (T/2) has passed from the illumination of the auxiliary flash light (the second time of flash light illumination), the main flash light of the low light amount is illuminated as the third time of flash light illumination. In this way, as shown in FIG. 12A and in (5) in FIG. 12B, the toner at the upper layer side and the toner at the lower layer side of the repeat region both exceed the toner fusing temperature and fuse again, and are fixed as a toner image, and the smoothness of the surface is improved. In this way, the toner image transferred to the recording medium 12 can, even in the repeat regions, be reliably fixed with good image quality and without deterioration in the image quality, such as voids or the like, arising.

Thus, in the flash fixing device relating to the present embodiment, during the period of time from the time that the main flash light of the low light amount is illuminated one time to the next time when the main flash light of the low light amount is illuminated, the auxiliary flash light from the auxiliary flash lamp 54 is illuminated onto each repeat region on the recording medium 12. Therefore, even in a case in which the toner image on the recording medium 12 is a color toner image, in which the toner images of the respective colors of C, M, Y, K are superposed on each other, and a large amount of energy is needed in order to fuse the entire amount of the toner, the toner image on the recording medium 12 can be reliably fixed, without deterioration in image quality, such as voids or the like, arising at the repeat regions on the recording medium 12.

Figure 13A:
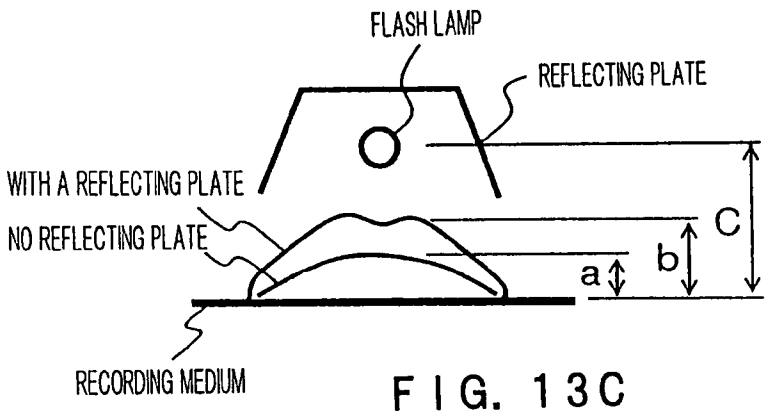
FIGS. 13A through 13D are schematic diagrams for explaining the effects of the distance between a flash lamp and the recording medium, and the presence/absence of a reflecting plate, on a light distribution pattern and an amount of illuminated light of flash light onto the recording medium.

Next, the effects of the distance between the flash lamp and the recording medium and the presence/absence of a reflecting plate, on the light distribution pattern and the amount of illuminated light of the flash light onto the recording medium, will be described. As shown in FIG. 13A, in a case in which one flash lamp is disposed so as to be separated from the recording medium by distance C, when a reflecting plate is provided at the rear of the flash lamp, the flash light illuminated onto the recording medium has the light distribution pattern denoted by "with a reflecting plate" in FIG. 13A (the maximum light amount in this light distribution pattern is "b"), whereas, if a reflecting plate does not exist at the rear of the flash lamp, the flash light illuminated onto the recording medium has the light distribution pattern denoted by "no reflecting plate" in FIG. 13A (the maximum light amount in this light distribution pattern is "a"). As is clear from FIG. 13A as well, in a case in which a reflecting plate is provided, the flash light, which is radiated toward the rear from the flash lamp, also is reflected at the reflecting plate and illuminated onto the recording medium. On the other hand, in a case in which there is no reflecting plate, only the flash light which is radiated from the flash lamp toward the recording medium (the direct light) is illuminated onto the recording medium, and therefore, the relationship of the magnitudes of the maximum light amounts "a" and "b" is $a<b$. Accordingly, in order to effectively use the energy of the flash lamp (the flash light), it is desirable to provide a reflecting plate at the rear of the flash lamp.

In the present invention, the auxiliary flash lamp 54 must be provided at a position corresponding to between the pair of main flash lamps 48A, 48D which are positioned at the both end portions along the recording medium 12 conveying direction, among the group of main flash lamps 48A through 48D. However, if the auxiliary flash lamp 54 is merely provided at a position at which the distance C is the same as that of the main flash lamp group (between the line-up of the group of main flash lamps 48A through 48D), the distance between the auxiliary flash lamp 54 and the group of main flash lamps 48A through 48D becomes too close, and there is the concern that the auxiliary flash lamp 54 may emit light simultaneously with the group of main flash lamps 48A through 48D due to a leak. Therefore, simultaneous light-emission must be prevented by making the distance C of the auxiliary flash lamp 54 and the distance C of the group of main flash lamps 48A through 48D different from one another, and placing the auxiliary flash lamp 54 a given distance (e.g., 8 mm) or more away from the group of main flash lamps 48A through 48D.

Figure 13B:
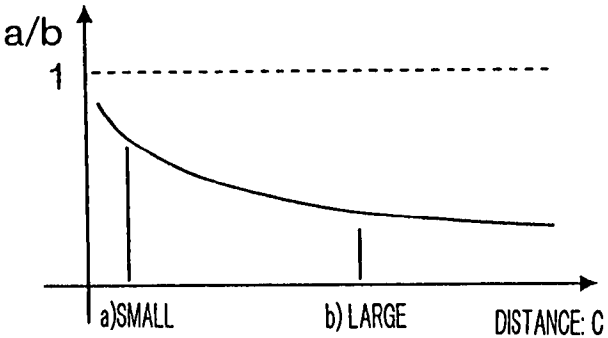

Here, the light amount ratio a/b of the maximum light amounts "a" and "b" varies in accordance with the distance C as shown in FIG. 13B, and exhibits the characteristic that the value thereof approaches 1 as the distance C becomes smaller. Therefore, in the present embodiment, the auxiliary flash lamp 54 is provided at a position which is closer to the recording medium 12 than the group of main flash lamps 48A through 48D (i.e., a position at which the distance C is smaller). In a case in which the auxiliary flash lamp 54 is set closer to the recording medium 12 than the group of main flash lamps 48A through 48D, if a reflecting plate exclusively for the auxiliary flash lamp 54 is provided, a portion of the main flash light is blocked by this reflecting plate, and there is therefore a high possibility that the light amount of the main flash light will decrease and disorder will arise in the light distribution pattern of the main flash light.

Figure 13C:
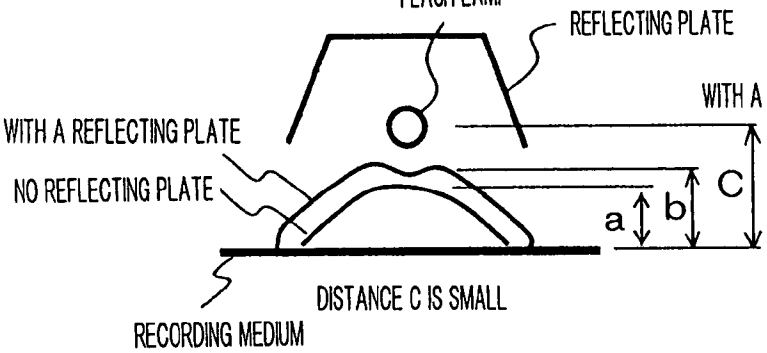

However, as shown in FIG. 13C as well, for a flash lamp whose distance C from the recording medium is small, the maximum light amount "a" of the light distribution pattern in a case in which there is no reflecting plate is a value which is near to the maximum light amount "b" of the light distribution pattern in a case in which there is a reflecting plate. Therefore, the auxiliary flash lamp 54, which is set closer to the recording medium 12 than the group of main flash lamps 48A through 48D, can achieve high energy efficiency even if a reflecting plate exclusively therefor is not provided. Further, in the present embodiment, the main objects are, as described above, to make the energy efficiency of the auxiliary flash lamp 54 (the auxiliary flash light) high, and for the illumination of the auxiliary flash light to suppress the decrease in the temperature of the toner in limited regions (the repeat regions) on the recording medium 12. On the basis of the fact that the energy to be supplied to the recording medium 12 by the auxiliary flash light is smaller than that of the group of main flash lamps 48A through 48D, the electrostatic capacity of the capacitor 62 of the power source circuit 58 connected to the auxiliary flash lamp 54 is made to be smaller than those of the power source circuits 58 connected to the main flash lamps 48, and the electrostatic energy supplied to the auxiliary flash lamp 54 at the time of light-emission is made to be smaller. Therefore, the increase in the amount of electric power which is consumed by making the auxiliary flash lamp 54 emit light can be kept to the minimum needed. Further, without providing a reflecting plate exclusively for the auxiliary flash lamp 54, and by making the auxiliary flash lamp 54 have a smaller diameter than that of the group of main flash lamps 48A through 48D, it is possible to prevent the light amount of the main flash light from decreasing and disorder of the light distribution pattern of the main flash light from arising.

Figure 13D:
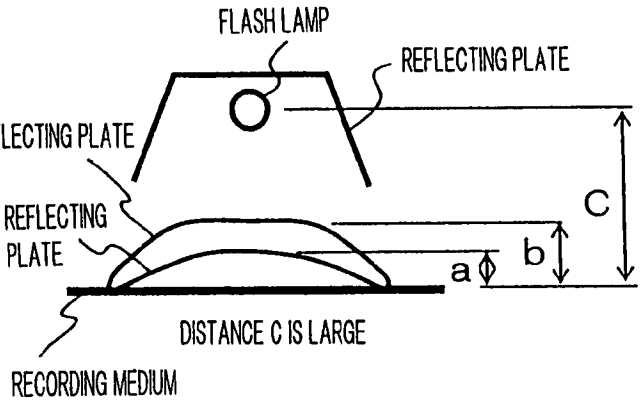

On the other hand, because the distance C to the recording medium is made to be larger for the group of main flash lamps 48A through 48D than for the auxiliary flash lamp 54, the maximum light amount of the light distribution pattern decreases. However, as shown in FIG. 13D as well, the light distribution pattern, in a case in which the distance C is large and there is a reflecting plate, is such that there is a uniform amount of illuminated light over a broad range. Because the amount of illuminated light of the main flash light onto the recording medium 12 can be made to be uniform over substantially the entire surface of the recording medium 12, coupled with the illumination of the auxiliary flash light onto the recording medium 12, the toner image which has been transferred to the recording medium 12 can be reliably fixed over the entire surface of the recording medium 12.

Note that the above describes an example in which the auxiliary flash lamp 54 is provided at a position corresponding to the center of the pair of the main flash lamps 48A, 48D which are positioned at the both end portions along the recording medium 12 conveying direction, among the group of main flash lamps 48A through 48D. However, the present invention is not limited to the same, and the auxiliary flash lamp 54 may be provided at a position which is offset from the aforementioned position along the recording medium 12 conveying direction (e.g., a position corresponding to between the main flash lamps 48A, 48B, or a position corresponding to between the main flash lamps 48C, 48D, or the like). In this case as well, it suffices to cause the auxiliary flash lamp 54 to emit light at the time when the substantially central portion of the repeat region on the recording medium 12 reaches a position direction beneath the position where the auxiliary flash lamp 54 is disposed.

Figure 14A:
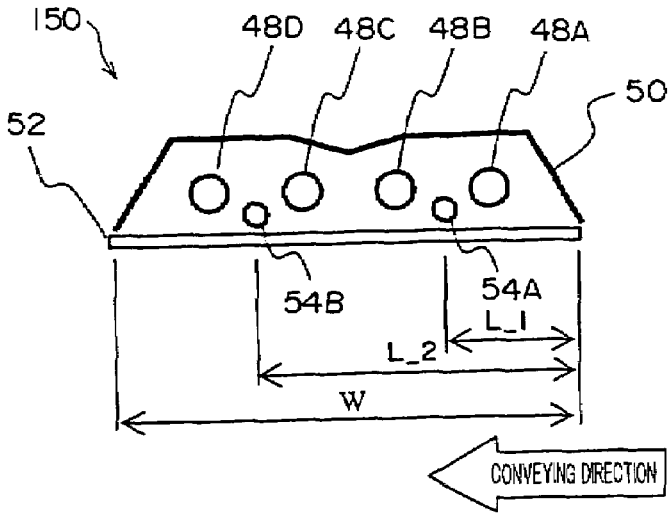
FIG. 14A is a schematic diagram showing another example of the flash fixing unit.

Further, the above describes an aspect in which only one auxiliary flash lamp 54 is provided, but the present invention is not limited to the same, and plural of the auxiliary flash lamps 54 may be provided. A flash fixing unit 150 which is provided with two auxiliary flash lamps 54A, 54B is shown as an example in FIG. 14A. In the flash fixing unit 150, the auxiliary flash lamp 54A is provided at a position which is at the center of the positions where the main flash lamps 48A, 48B are disposed and which is offset slightly below the arrangement of the group of main flash lamps 48A through 48D. The auxiliary flash lamp 54B is provided at a position which is at the center of the positions where the main flash lamps 48C, 48D are disposed and which is offset slightly below the arrangement of the group of main flash lamps 48A through 48D.

Figure 14B:
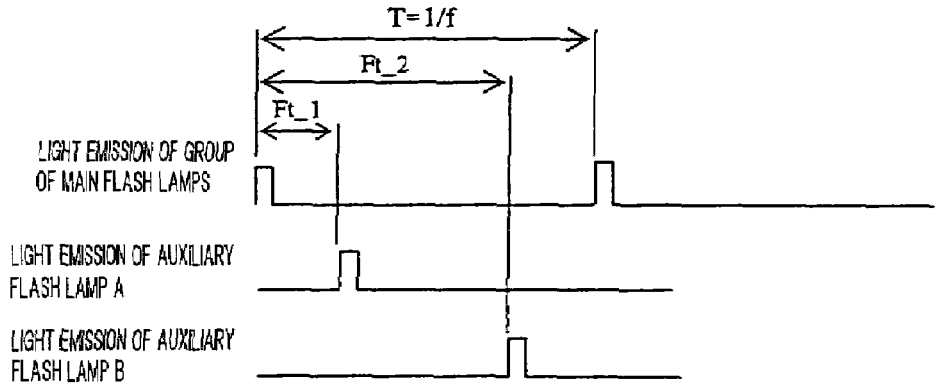
FIG. 14B is a timing chart showing light-emission timings of the group of main flash lamps and the auxiliary flash lamps.

In the above-described structure, making the auxiliary flash lamps 54 emit light at the times when the substantially central portion of the repeat region on the recording medium 12 reaches the positions directly beneath the positions where the auxiliary flash lamps 54 are disposed can be realized as follows (refer to FIG. 14B as well): given that the position of an individual auxiliary flash lamp x (where x is a reference numeral identifying the individual auxiliary flash lamp 54, and here, the auxiliary flash lamp 54A is x=1 and the auxiliary flash lamp 54B is x=2) at the time when the position of the recording medium 12 conveying direction upstream side end portion of the opening portion of the flash fixing unit 150 is used as a reference, is L_x, the opening width of the flash fixing unit 150 is W, the conveying speed of the recording medium 12 is v, and the light-emission frequency of the group of main flash lamps 48A through 48D is f (=1/light-emission period T), the individual auxiliary flash lamp x is made to emit light after a time Ft_x expressed by following formula (1) has elapsed from the time that the group of main flash lamps 48A through 48D emitted light.

$$\mathrm{Ft_x} = \frac{1}{f}\left\{\frac{\mathrm{L_x} - \frac{(W - v/f)}{2}}{v/f}\right\} \tag{1}$$

Figure 15:
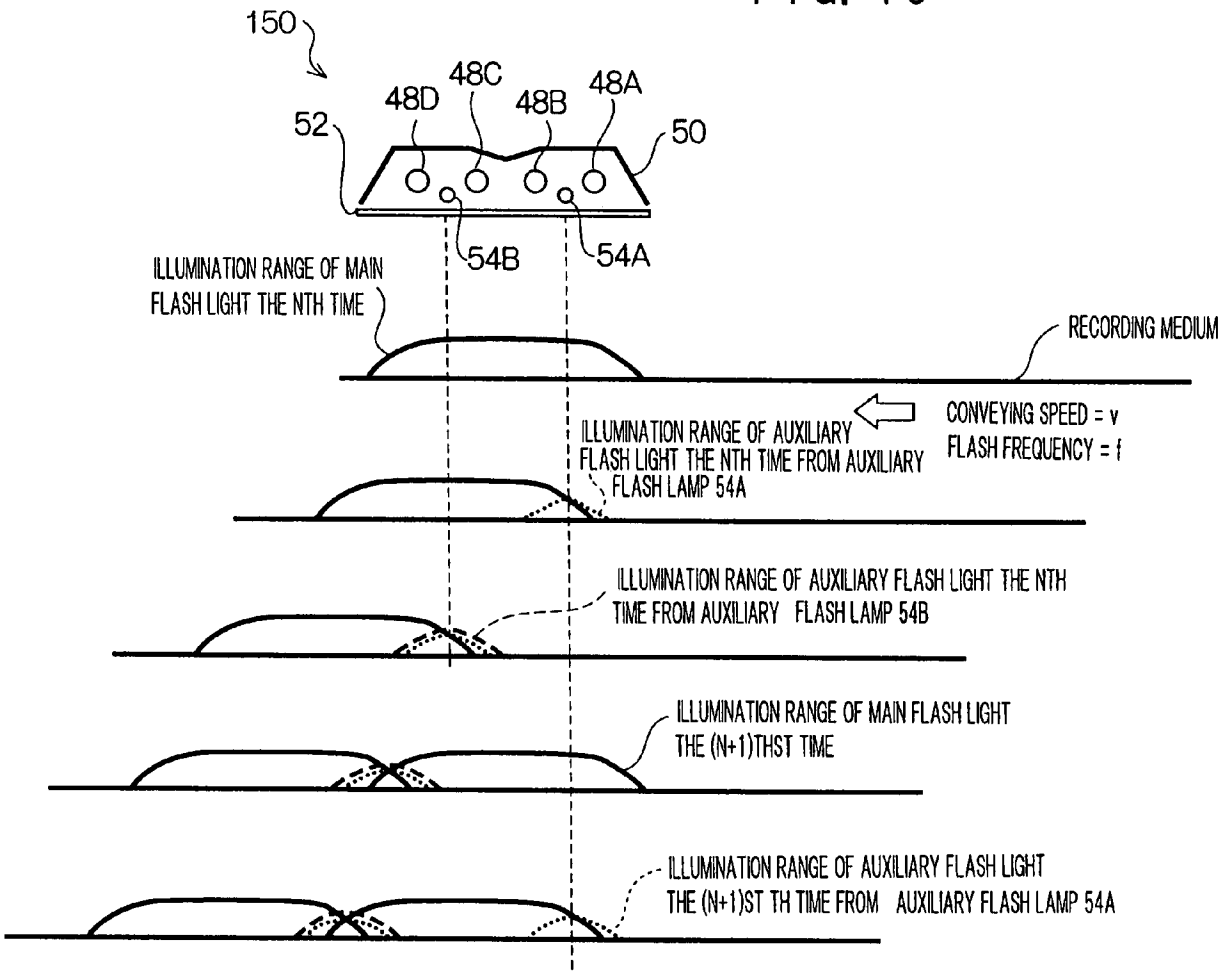
FIG. 15 is a schematic diagram showing the progression of illumination of flash light onto respective portions on the recording medium, in a case in which the flash fixing unit of FIG. 14A is used.
Figure 16:
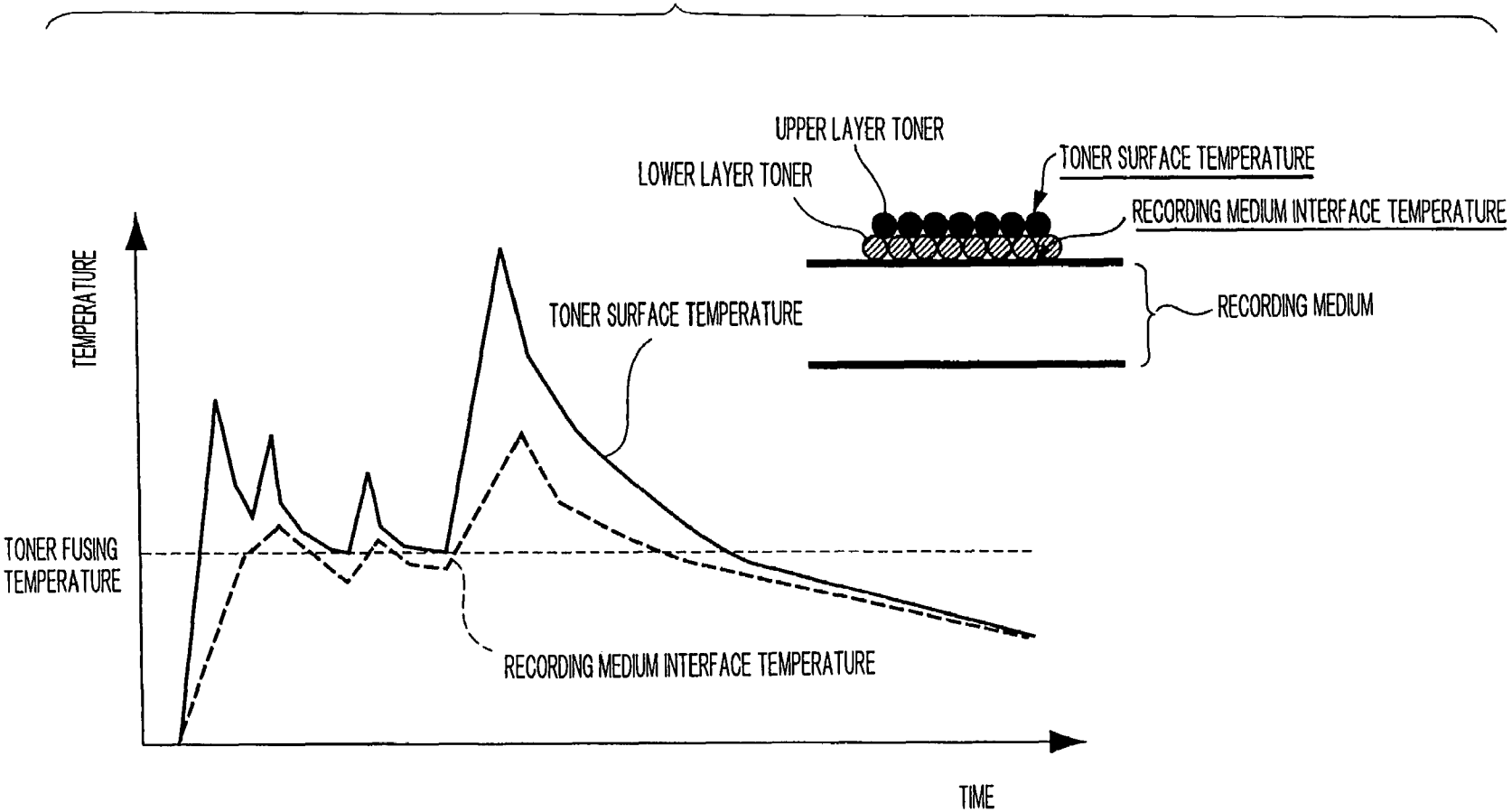
FIG. 16 is a graph showing the progression of temperatures of the toner surface and the recording medium interface in the repeat region, in the case in which the flash fixing unit shown in FIG. 14A is used.

In this way, as shown in FIG. 15 as well, at each repeat region on the recording medium 12, during the period of time from the time when main flash light of the low light amount is illuminated one time to the next time when the main flash light of the low light amount is illuminated, auxiliary flash light from each of the auxiliary flash lamps 54A, 54B is illuminated one time, such that flash light is illuminated a total of four times. Due to flash light being illuminated four times onto the repeat region on the recording medium 12, the toner surface temperature and the recording medium interface temperature at the repeat region vary as shown in FIG. 16. As is clear from comparing the toner surface temperature and the recording medium interface temperature shown in FIG. 16 with FIG. 12A, it can be understood that, in the case of using the flash fixing unit 150 which is provided with the two auxiliary flash lamps 54A, 54B, the decrease in the toner surface temperature and the recording medium interface temperature during the period of time from the time that the main flash light of the low light amount is illuminated one time to the next time when the main flash light of the low light amount is illuminated, is smaller, and the toner surface temperature and the recording medium interface temperature are maintained at a higher temperature in the aforementioned period, and the occurrence of deterioration in image quality such as voids or the like in the repeat regions of the recording medium 12 can be prevented more reliably.

Figure 17A:
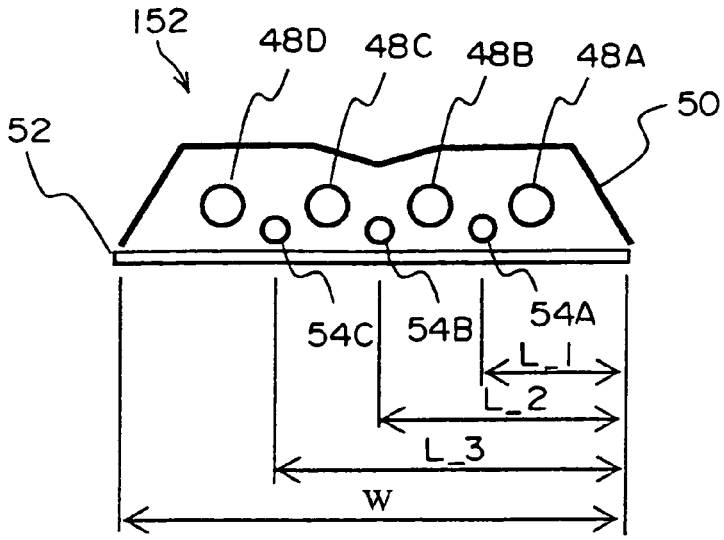
FIG. 17A is a schematic diagram showing yet another example of the flash fixing unit.
Figure 17B:
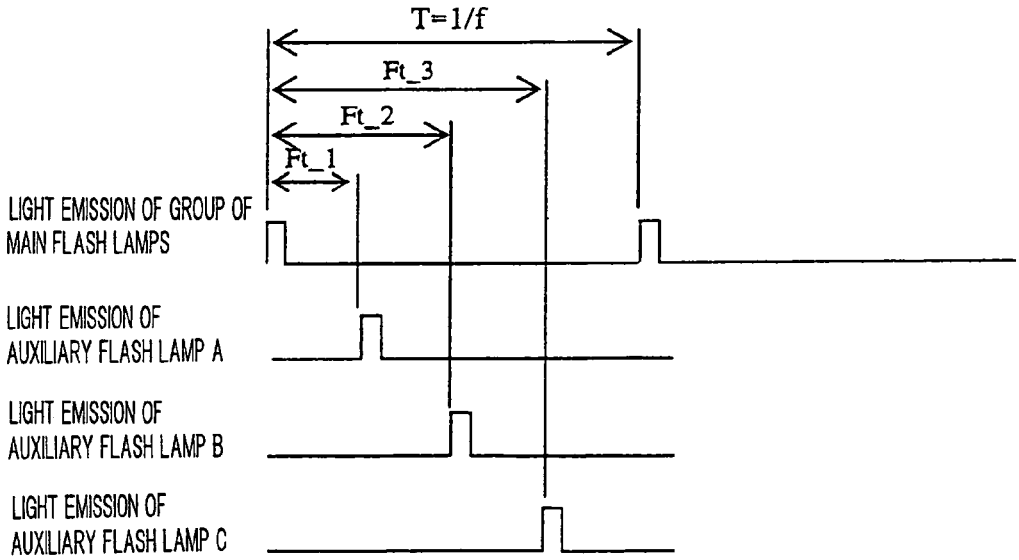
FIG. 17B is a timing chart showing light-emission timings of the group of main flash lamps and the auxiliary flash lamps.

A flash fixing unit 152 which is provided with three auxiliary flash lamps 54A through 54C is shown in FIG. 17A. The flash fixing unit 152 is provided with: the auxiliary flash lamp 54A, at a position which is at the center of the positions where the main flash lamps 48A, 48B are disposed and which is offset slightly below the arrangement of the group of main flash lamps 48A through 48D; the auxiliary flash lamp 54B, at a position which is at the center of the positions where the main flash lamps 48B, 48C are disposed and which is offset slightly below the arrangement of the group of main flash lamps 48A through 48D; and an auxiliary flash lamp 54C, at a position which is at the center of the positions where the main flash lamps 48C, 48D are disposed and which is offset slightly downward from the arrangement of the group of main flash lamps 48A through 48D. In the flash fixing unit 152 as well, making the individual auxiliary flash lamps 54 emit light at times when the substantially central portion of the repeat region on the recording medium 12 reaches positions directly beneath the positions where the individual auxiliary flash lamps 54 are disposed, can be realized by causing the individual auxiliary flash lamps x to respectively emit light after times Ft_x shown by previous formula (1) have elapsed from the time that the group of main flash lamps 48A through 48D emitted light (refer to FIG. 17B as well).

In this way, at each repeat region on the recording medium 12, during the period of time from the time when main flash light of a low light amount is illuminated one time to the next time when main flash light of a low light amount is illuminated, auxiliary flash light from each of the auxiliary flash lamps 54A through 54C is illuminated one time, such that the flash light is illuminated a total of five times. The occurrence of deterioration in image quality such as voids or the like in the repeat regions of the recording medium 12 can be prevented more reliably.

Figure 18:
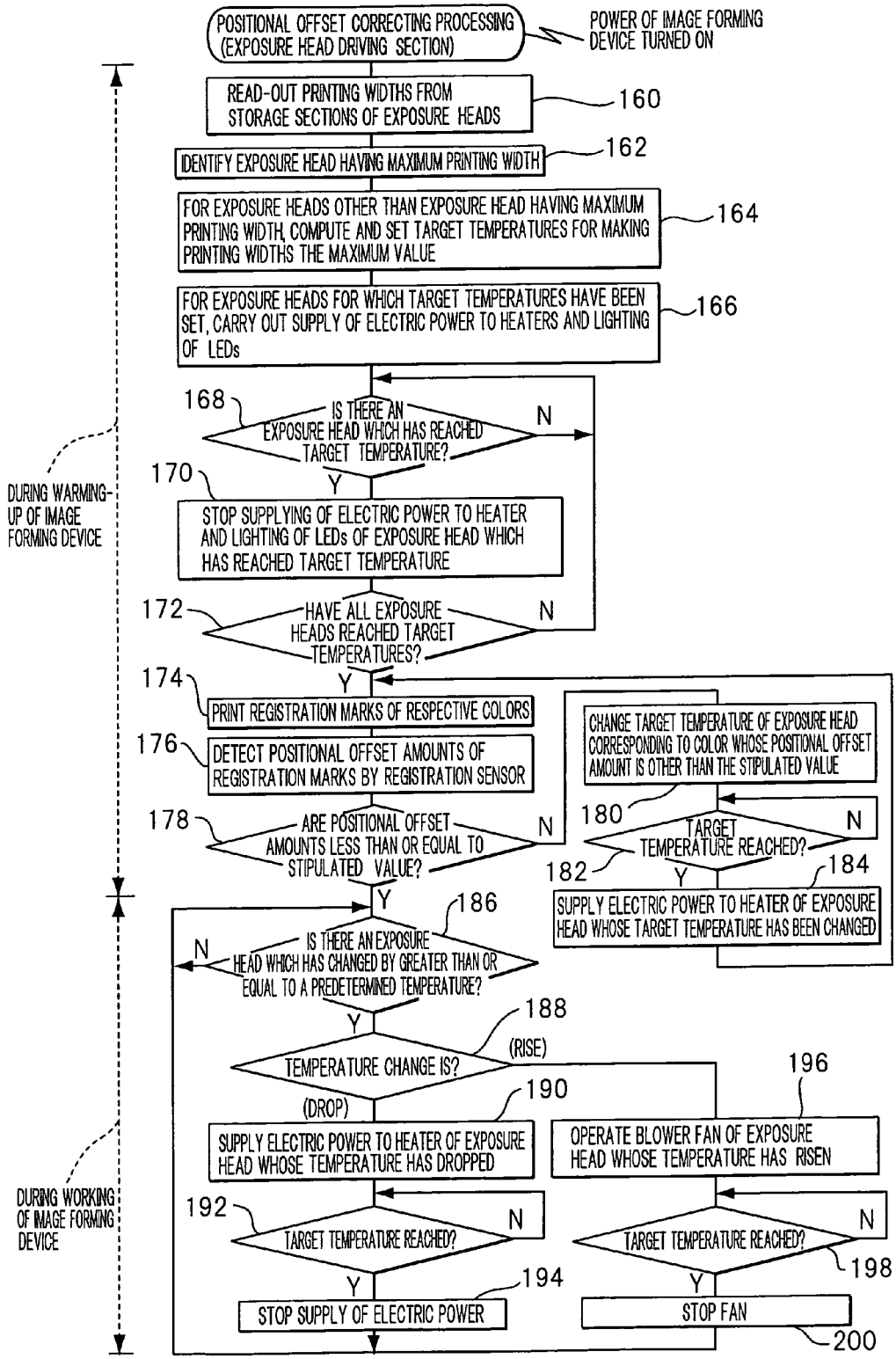
FIG. 18 is a flowchart showing contents of positional offset correction processing carried out by an exposure head driving section.

Operation of the positional offset correcting device will be described next. When the power of the color image forming device 10 is turned on, the exposure head driving section 110 of the positional offset correcting device carries out the positional offset correcting processing shown in FIG. 18. In this positional offset correcting processing, the procedures of step 160 through step 184 are carried out during the time when the color image forming device 10 is warming-up, and the procedures of step 186 through step 200 are carried out while the color image forming device 10 is working.

While the color image forming device 10 is warming-up, first, in step 160, the printing widths of the individual exposure heads 24 which were measured at the time of manufacturing are read-out from the storage sections 108 attached to the exposure heads 24 of the image forming sections 18A through 18D. In next step 162, the exposure head 24 having the maximum read-out printing width is identified. In the positional offset correcting processing relating to the present embodiment, positional offset is corrected by heating the substrates 94 of the exposure heads 24 by the heaters 100 and causing the longitudinal direction sizes of the substrates 94 to extend such that the printing widths of the individual exposure heads 24 are made to coincide with one another. In next step 164, the printing width of the exposure head 24 which was identified in step 162 (the maximum value of the printing widths) is used as a reference, and for the individual exposure heads 24 other than the exposure head 24 having the maximum printing width, a target temperature of the substrate 94 which makes the printing width coincide with the maximum value is computed and set for each of the individual exposure heads 24, other than the exposure head 24 whose printing width is the maximum, on the basis of the deviation between the printing width of that individual exposure head 24 and the maximum value of the printing widths, and the relationship (see FIG. 7) between the output of the heater 100 and the amount of change in the printing width of the exposure head 24 (the correction amount), which relationship is stored in the storage section incorporated in the exposure head driving section 110.

Figure 19:
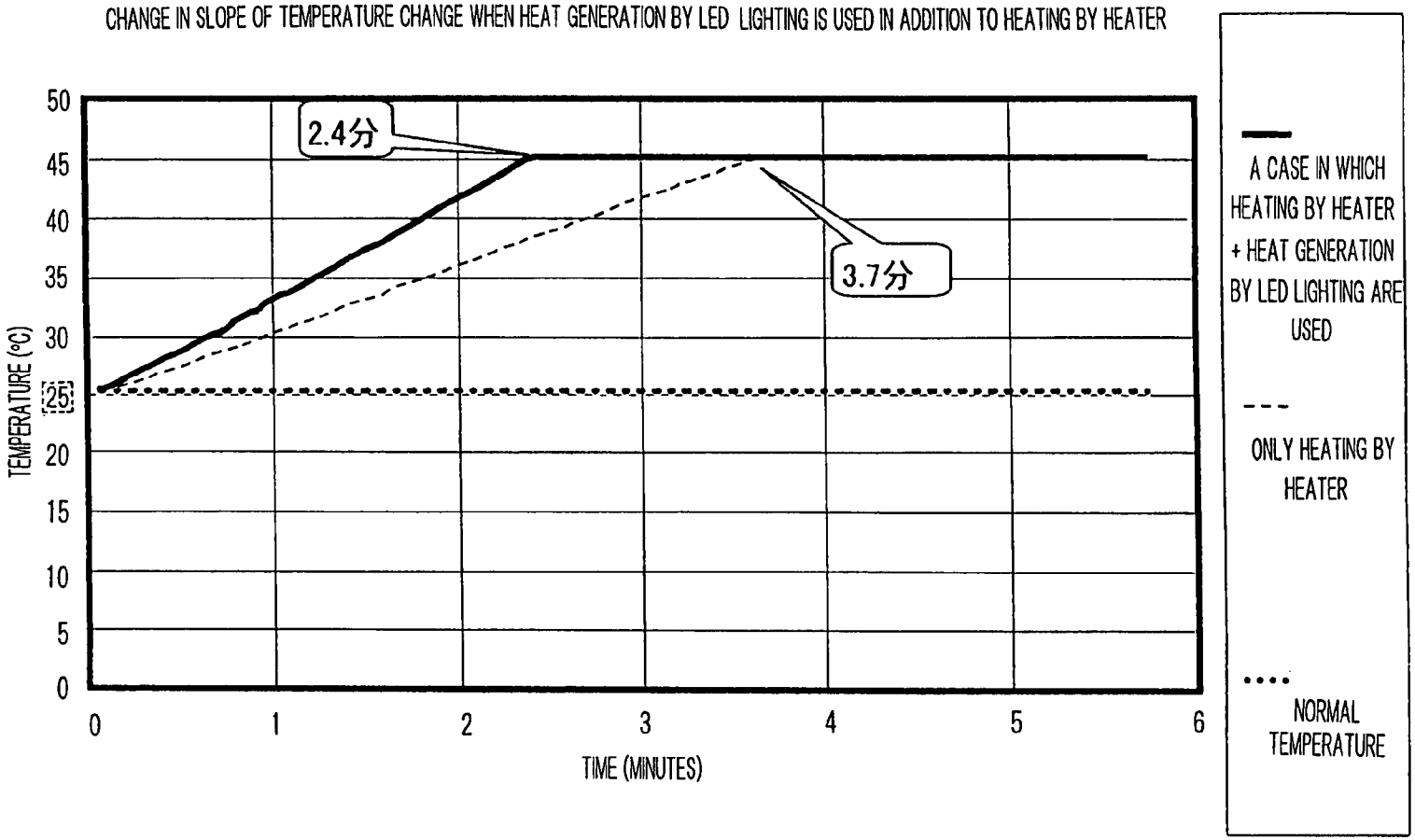
FIG. 19 is a graph showing the change in the slope of the temperature change in a case in which the generation of heat by lighting of LEDs is used, in addition to heating by a heater, as heating of a substrate of an exposure head.

When the power of the color image forming device 10 is turned on, the temperatures of the substrates 94 of the individual exposure heads 24 are relatively low temperatures, and the deviations between the present temperatures and the target temperatures of the exposure heads 24 for which target temperatures have been set are relatively large. Therefore, in step 166, for the exposure heads 24 for which target temperatures were set in step 164 (the exposure heads 24 whose printing widths are not the maximum), supplying of electric power to the heater 100 and illuminating of the LEDs 92 is carried out. In this way, at the exposure heads 24 whose printing widths are not the maximum, the substrates 94 are heated by the generation of heat by the heaters 100, and the substrates 94 are heated also due to the generation of heat which accompanies the lighting of the LEDs 92. As shown as an example in FIG. 19 as well, the slope of the temperature increase of the substrates 94 is greater than in a case in which only heating by the heaters 100 is carried out. Therefore, the substrates 94 of the individual exposure heads 24 reach the target temperatures in a relatively short period of time, and the time needed to warm-up the color image forming device 10 can be shortened.

In subsequent step 168, the temperatures of the substrates 94, which are detected by the temperature sensors 106 attached to the individual exposures heads 24, are downloaded, and by comparing the detected values of the downloaded temperatures with the target temperatures, it is judged whether an exposure head 24 at which the temperature of the substrate 94 has reached the target temperature has emerged. Step 168 is repeated until this judgment is affirmative. When the judgment of step 168 is affirmative, the routine moves on to step 170 where the supplying of electric power to the heater of the exposure head 24 at which the temperature of the substrate 94 has reached the target temperature, and the illuminating of the LEDs 92 thereof, is stopped. In next step 172, it is judged whether or not the temperatures of the substrates 94 have reached the target temperatures at all of the exposure heads 24 at which heating was carried out by the heaters 100 and the LEDs 92. If the judgment is negative, the routine returns to step 168, and steps 168 through 172 are repeated until the judgment of step 172 is affirmative.

When the temperatures of the substrates 94 have reached the target temperatures at all of the exposure heads 24 at which heating was carried out by the heaters 100 and the LEDs 92, the judgment in step 172 is affirmative, and the routine moves on to step 174 where toner images corresponding to registration marks of the respective colors are formed on the peripheral surfaces of the photosensitive drums 20 by the image forming sections 18A through 18D, and the formed toner images of the registration marks are transferred onto the recording medium 12, and the registration marks of the respective colors are thereby printed onto the recording medium 12. Note that it suffices for the registration marks to be marks which enable measurement of the printing widths of the exposure heads 24 by clarifying the positions of the both end portions of the printing ranges by the exposure heads 24 of the image forming sections 18A through 18D, and arbitrary marks may be used therefor. In the next step 176, the positional offset amounts of the registration marks of the respective colors printed on the recording medium 12 are detected by the registration sensor 44. Then, in step 178, it is judged whether or not the positional offset amounts of the registration marks of the respective colors detected by the registration sensor 44 are respectively less than or equal to a stipulated value. When the judgment in step 178 is affirmative, it can be judged that the printing widths of the exposure heads 24 substantially match. Therefore, the processing at the time of warming-up is ended, and the routine moves on to step 186.

On the other hand, in a case in which the positional offset amount of the registration mark of any color has exceeded the stipulated value, the judgment of step 178 is negative, and the routine proceeds to step 180 where the target temperature of the substrate 94 of the exposure head 24 corresponding to the color at which the positional offset amount of the registration mark exceeded the stipulated value, is changed in accordance with the detected positional offset amount of the registration mark. In step 184, the supplying of electric power to the heater 100 of the exposure head 24 at which the target temperature of the substrate 94 has been changed, is started. In step 182, it is judged whether or not the temperature of the substrate 94 of the exposure head 24, at which the supplying of electric power to the heater 100 has been started, has reached the target temperature changed in step 180. Step 184 is repeated until this judgment is affirmative. When the judgment in step 182 is affirmative, the routine returns to step 174, and the procedures from step 174 on are repeated. In this way, even in cases in which the positional offset amount of the registration mark of any color exceeds the stipulated value, by repeating the procedures of steps 180 through 184 until the judgment of step 178 is affirmative, the printing widths of the exposure heads 24 can be made to substantially coincide with one another, and color offset and the like at the time of forming a color image is suppressed.

The procedures which are carried out while the color image forming device 10 is working, in the positional offset correction processing which is carried out by the exposure head driving section 110, will be described next. In step 186, the temperatures of the substrates 94, which are detected by the temperature sensors 106 added to the exposure heads 24, are downloaded, and it is judged whether or not there is an exposure head 24 at which the temperature of the substrate 94 has changed by a predetermined value or more. If this judgment is negative, step 186 is repeated. For example, in a case in which there is an exposure head 24 at which the temperature of the substrate 94 has reached the target temperature by being heated by the heater 100 and the like at the time of warming-up, but then after start up the temperature of the substrate 94 has fallen by a predetermined value or more from the target temperature due to a continuous state in which the LEDs 92 are not illuminated, or when after start up of the exposure head 24 whose printing width is the maximum value the temperature of the substrate 94 rises by a predetermined value from the initial temperature due to continuous illumination of the LEDs 92 continuing from, the judgment in step 186 is affirmative. The routine moves on to step 188 where it is judged whether or not the sensed temperature change of a predetermined value or more is a drop in temperature or a rise in temperature.

If the sensed temperature change is a drop in the temperature of the substrate 94, the routine moves on from step 188 to step 190 where supplying of electric power to the heater 100 of the exposure head 24 at which the temperature of the substrate 94 has dropped is started, and the heating of the substrate 94 of that exposure head 24 is thereby started. In next step 192, the temperature of the substrate 94, detected by the temperature sensor 106 attached to the exposure head 24 at which the supplying of electric power to the heater 100 has started, is downloaded, and it is judged whether or not the temperature of the substrate 94 has risen to the target temperature. Step 194 is repeated until the judgment is affirmative. Then, when the temperature of the substrate 94 of the exposure head 24 at which the supplying of electric power to the heater 100 has started, rises to the target temperature, the judgment in step 192 is affirmative. The routine moves on to step 194 where the supplying of electric power to the heater 100 is stopped. The routine then returns to step 186.

Further, in a case in which the sensed temperature change is a rise in temperature of the substrate 94, the routine moves from step 188 to step 196 where the blower fan 112, which is provided in a vicinity of the exposure head 24 at which the temperature of the substrate 94 has risen, is operated. By supplying a flow of air toward the exposure head 24 at which the temperature of the substrate 94 has risen, cooling of the substrate 94 of that exposure head 24 is started. In next step 198, the temperature of the substrate 94, detected by the temperature sensor 106 attached to the exposure head 24 at which the blower fan 112 is operated, is downloaded, and it is judged whether or not the temperature of the substrate 94 has fallen to the target temperature. Step 198 is repeated until the judgment is affirmative. Note that, in a case in which the exposure head 24 at which the blower fan 112 is operated is the exposure head 24 having the maximum printing width, the temperature of the substrate 94 at the time of warming-up is the target temperature. Then, when the temperature of the substrate 94 of the exposure head 24 at which the blower fan 112 is operated falls to the target temperature, the judgment in step 198 is affirmative. The routine moves on to step 200 where operation of the blower fan 112 is stopped, and the routine then returns to step 186.

Due to the above-described procedures being carried out by the exposure head driving section 110 during the time when the color image forming device 10 is working, the substrates 94 of the exposure heads 24 of the image forming sections 18A through 18D are maintained at temperatures near to the target temperatures. Even in cases such as when color image formation is carried out after the continuation of a state in which only the LEDs 92 of a specific exposure head 24 are lit, or the like, the occurrence of color offset and the like in formed color images can be prevented.

Figure 20A:
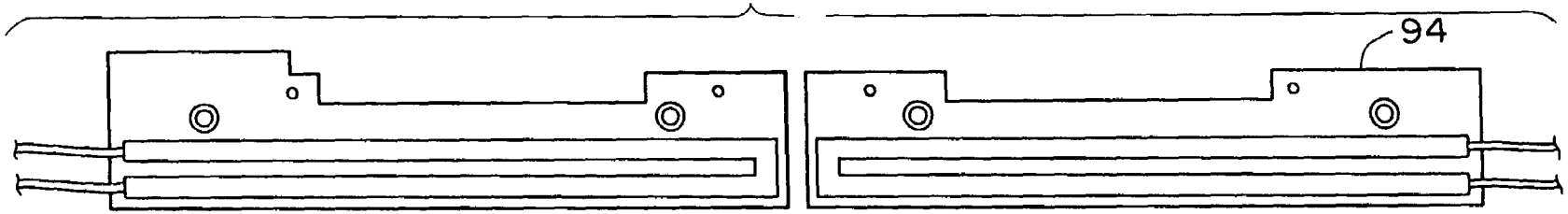
FIG. 20A is a plan view showing another example of wiring patterns of resistor elements structuring the heater.
Figure 20B:
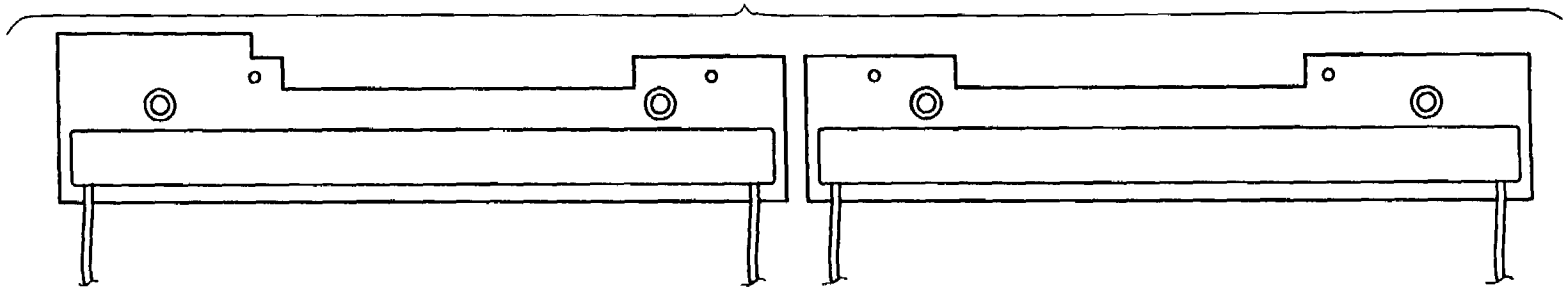
FIG. 20B is a plan view showing yet another example of wiring patterns of resistor elements structuring the heater.

Note that the wiring pattern of the resistor element structuring the heater 100 is not limited to the wiring patterns 102 shown in FIGS. 5A and 5B. For example, as shown in FIGS. 20A and 20B, the heating range by the heater 100 may be divided into plural ranges (two ranges in FIGS. 20A and 20B), and a wiring pattern of a resistor element may be provided independently for each heating range. Note that FIGS. 20A and 20B show examples in which the substrate 94 itself is also divided into the respective heating ranges, but it is of course possible for the substrate 94 itself to be made be integral and only the wiring patterns of the resistor elements to be provided independently per heating range. With regard to the wiring patterns shown in FIGS. 20A and 20B as well, although the wiring pattern shown in FIG. 20B is disadvantageous in terms of the routing of the wires, the electrical resistance values of the resistor elements corresponding to the individual heating ranges can be made to be low and the output of the heater 100 can be made to be high. Therefore, the wiring pattern shown in FIG. 20B is preferable.

Figure 21A:
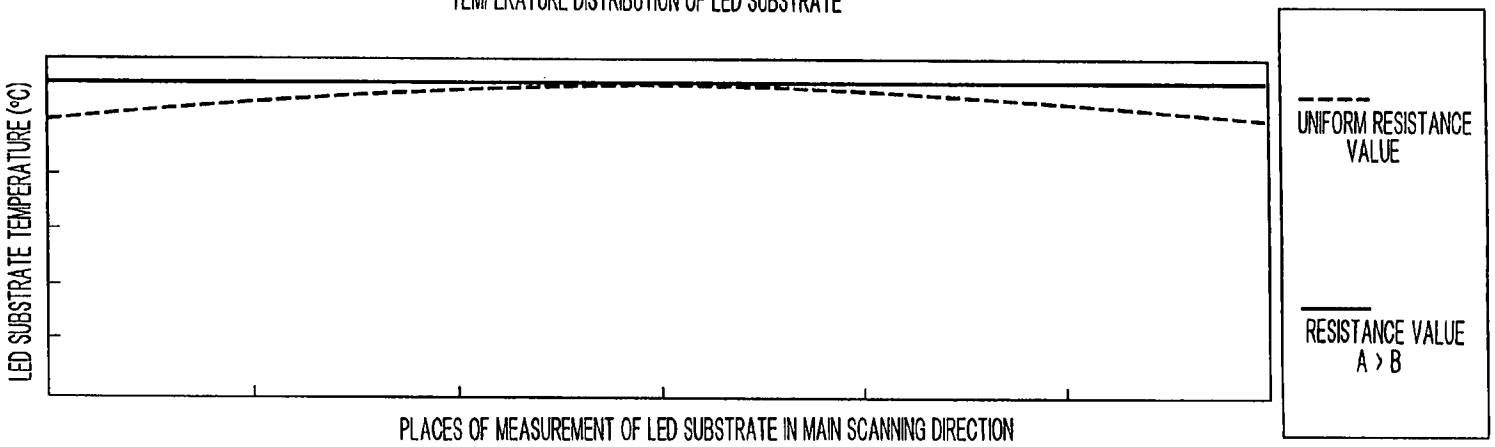
FIG. 21A is a graph showing an example of a temperature distribution on the substrate of the exposure head.

The wiring patterns of the resistor elements shown in FIGS. 5A and 5B and in FIGS. 20A and 20B are structured such that the substrate 94 of the exposure head 24 is heated uniformly over the entire surface thereof. Because the substrate 94 of the exposure head 24 relating to the present embodiment has a long, thin configuration, it is easier for the two end portions of the substrate 94 to discharge heat than the central portion thereof. In the case of heating the substrate 94 by the heater 100 having the wiring pattern of the resistor element as shown in FIGS. 5A and 5B or FIGS. 20A and 20B it is easy for there to become a temperature distribution in which the temperatures at the both end portions are lower than at the central portion of the substrate 94, as shown by the dashed line in FIG. 21A. Further, due to the degree of elongation of the substrate 94 becoming non-uniform due to this temperature distribution, there is the possibility that the non-uniformity of the intervals of the LEDs 92, and accordingly, non-uniformity of the individual dot positions of the image formed by the exposure head 24, will arise. In consideration thereof, the wiring pattern of the resistor element structuring the heater 100 may be structured such that the amount of heat generated at the both end portions of the substrate 94 is greater than at the central portion thereof.

Figure 21B:
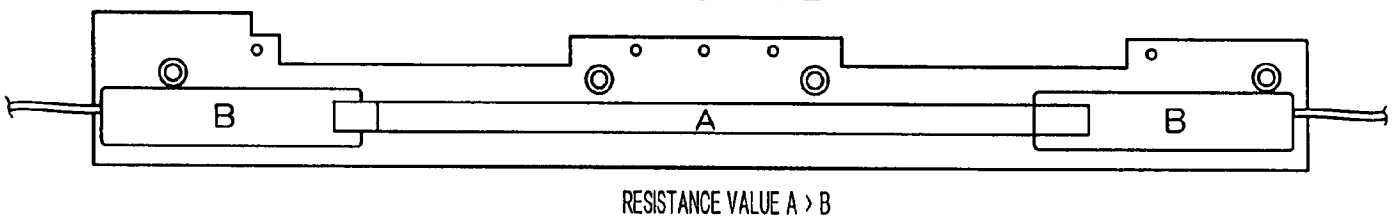
FIG. 21B is a plan view showing another example of wiring patterns of the resistor elements.
Figure 22:
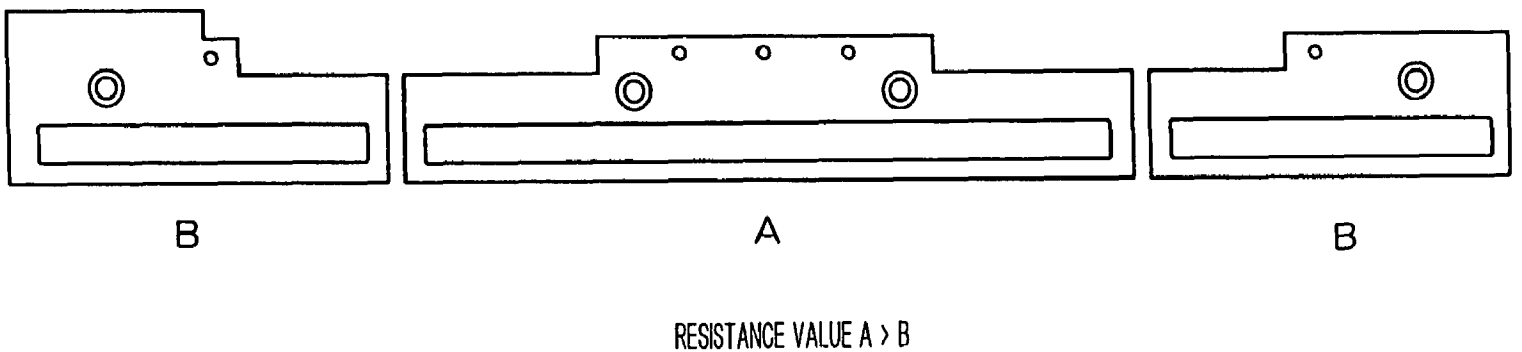
FIG. 22 is a plan view showing another example of wiring patterns of the resistor elements.

This can be realized by, as shown in FIG. 21B for example, making the widths of the wiring patterns of the resistor elements greater at the both end portions of the substrate 94 than at the central portion of the substrate 94. Further, this can also be realized by, as shown in FIG. 22 for example, dividing the heating range by the heater 100 into three ranges which are the central portion of the substrate 94 and the both end portions of the substrate 94, separately providing a wiring pattern of a resistor element at each heating range, and making the electrical resistances B of the wiring patterns of the resistor elements provided at the both end portions of the substrate 94 smaller than the electrical resistance A of the wiring pattern of the resistor element provided at the central portion of the substrate 94 (A>B). In this way, as shown as an example by the solid line in FIG. 21A, the temperature of the substrate 94 can be made to be uniform over the entire surface, and the occurrence of non-uniformity of the intervals of the LEDs 92 and non-uniformity of the individual dot positions of the image formed by the exposure head 24 can be prevented.

The operation of the charging wire cleaning device will be described next. The charging wire cleaning control section 140 of the charging wire cleaning device carries out the charging wire cleaning processing shown in FIG. 23 each time that a charger cleaning command, which instructs cleaning of the chargers 22, is inputted from outside (e.g., a control section (not shown) which controls the entire color image forming device 10, or the like). Note that, when this charging wire cleaning processing is carried out, the cleaning pad carrier 130 is in a state of being positioned at the position at which the gears 136 mesh-together with the gear 124 (standby position/pad rotating position). In step 220, the roughness of the cleaning pads 138 to be used in cleaning is selected, and the motor 128 is driven and the cleaning pads 138 rotated such that the pads of the selected roughness among the pads 138A through 138C structuring the cleaning pads 138 contact the charging wire 116. Note that, in selecting the pads in step 220, a given pad may always be selected, or the pad which was selected when the charging wire cleaning processing was executed the previous time may be selected.

In next step 222, the surface of the photosensitive drum 20 is charged by the charging wire 116, the photosensitive drum 20 is rotated, and the potential of the portion of the peripheral surface of the photosensitive drum 20 that was charged by the charging wire 116 is measured by the surface potential sensor 146 as the pre-cleaning surface potential. In step 224, due to the motor 122 being driven, the cleaning pad carrier 130 is moved along the charging wire 116. The movement of the cleaning pad carrier 130 may be movement from the standby position to the end portion at the opposite side of the moving range of the cleaning pad carrier 130, or the cleaning pad carrier 130 may be moved reciprocatingly such that the cleaning pad carrier 130 is moved so as to be positioned back again at the standby position.

As the cleaning pad carrier 130 moves, due to the cleaning pads 138 sliding while contacting the charging wire 116, the charging wire 116 is cleaned. Further, the magnitude of the driving current flowing through the motor 122 when the motor 122 is driving is detected by the motor driving circuit 142. Accompanying the aforementioned sliding of the cleaning pads 138, a load corresponding to the degree of dirtying of the charging wire 116 is applied to the motor 122 (the greater the degree of dirtying of the charging wire 116, the greater the load that is applied to the motor 122). Therefore, the magnitude of the driving current which is detected by the motor driving circuit 142 also varies in accordance with the degree of dirtying of the charging wire 116. When movement of the cleaning pad carrier 130 ends, the charging wire cleaning control section 140 downloads the driving current value detected by the motor driving circuit 142.

In next step 226, among the numbers of times of movement of the cleaning pads stored for the respective pads 138A through 138C in a non-volatile memory incorporated in the charging wire cleaning control section 140, the number of times of movement of the cleaning pads corresponding to the pads which are currently contacting the charging wire 116 (the pads selected in previous step 220) is incremented by one. Note that the numbers of times of movement of the cleaning pads is cleared to zero when the color image forming device 10 is shipped-out, and is also cleared to zero when the cleaning pads 138 are replaced. In step 228, the surface of the photosensitive drum 20 is charged by the charging wire 116, the photosensitive drum 20 is rotated, and the potential of the charged portion on the peripheral surface of the photosensitive drum 20 is measured as the post-cleaning surface potential by the surface potential sensor 146. Then, in step 230, on the basis of the measured pre-cleaning surface potential and post-cleaning surface potential, and the driving current value of the motor 122 during cleaning which is downloaded from the motor driving circuit 142, and the numbers of times of movement of the cleaning pads for each of the pads 138A through 138C, to re-clean or not, the number of times to re-clean, and the roughness of the cleaning pads 138 to be used in cleaning, are determined.

Specifically, for example, if the post-cleaning surface potential is greater than or equal to a stipulated value and the driving current value of the motor 122 is less than a threshold value th1, it is judged that re-cleaning is unnecessary. Further, if the post-cleaning surface potential is less than a stipulated value and the driving current value of the motor 122 is greater than or equal to the threshold value th1 and less than a threshold value th2 (th2>th1), it is judged that re-cleaning is necessary, and the pads having the smallest roughness among the pads 138A through 138C are selected as the pads to be used in cleaning, and the number of times of re-cleaning is determined in accordance with the driving current value and the deviation between the pre-cleaning surface potential and the post-cleaning surface potential. However, in a case in which the number of times determined of movement of the pads having the lowest roughness is greater than or equal to a predetermined value, the pads having an intermediate roughness are selected as the pads to be used in cleaning, and the number of times of re-cleaning is determined so as to be smaller. Moreover, if the post-cleaning surface potential is less than a stipulated value and the driving current value of the motor 122 is greater than or equal to the threshold value th2 and less than a threshold value th3 (th3>th2), it is judged that re-cleaning is necessary, and the pads of the intermediate roughness are selected as the pads to be used in cleaning, and the number of times of re-cleaning is determined in accordance with the driving current value and the deviation between the pre-cleaning surface potential and the post-cleaning surface potential. However, in a case in which the determined number of times of movement of the pads of the intermediate roughness is greater than or equal to a predetermined value, either the pads having the greatest roughness are selected as the pads to be used in cleaning and the number of times of re-cleaning is determined so as to be lower, or the pads having the smallest roughness are selected as the pads to be used in cleaning and the number of times of re-cleaning is determined so as to be greater. In addition, if the post-cleaning surface potential is less than a stipulated value and the driving current value of the motor 122 is greater than or equal to the threshold value th3, it is judged that re-cleaning is necessary, and the pads having the greatest roughness are selected as the pads to be used in cleaning, and the number of times of re-cleaning is determined in accordance with the driving current value and the deviation between the pre-cleaning surface potential and the post-cleaning surface potential. However, in a case in which the number of times of movement of the pads having the greatest roughness is greater than or equal to a predetermined value, the pads having of the intermediate roughness are selected as the pads to be used in cleaning and the number of times of re-cleaning is determined so as to be greater. Note that the above-described method of determining whether or not to carry out re-cleaning, the number of times of re-cleaning, and the roughness of the cleaning pads 138 to be used in cleaning, is merely an example, and another determining method may be employed.

In next step 232, it is judged whether or not re-cleaning was judged to be necessary in previous step 230. If it was judged that re-cleaning is unnecessary, the judgment is negative and the routine moves on to step 246. If it was judged that re-cleaning is necessary, the judgment in step 232 is affirmative, and the routine moves on to step 234 where, by judging whether or not the roughness determined as the roughness of the pads to be used in cleaning is different than the roughness of the pads which are presently contacting the charging wire 116, it is judged whether or not there is the need to change the roughness of the cleaning pads 138.

If this judgment is negative, the routine moves on to step 240 without any processing being carried out. However, if the judgment is affirmative, the routine moves on to step 236, and, by driving the motor 122, the cleaning pad carrier 130 is moved to the pad rotating position (the standby position). Note that, in the case in which the cleaning pad carrier 130 is moved reciprocatingly in previous step 224, the cleaning pad carrier 130 is already positioned at the pad rotating position (the standby position) at the point in time when the processing of step 224 finishes, and this step 236 is unnecessary. Then, in step 238, the motor 128 is driven and the cleaning pads 138 are rotated so that the pads of the previously-determined roughness contact the charging wire 116.

In next step 240, by driving the motor 122 and moving the cleaning pad carrier 130 along the charging wire 116, the charging wire 116 is cleaned. In step 242, among the numbers of times of movement of the cleaning pads stored for the respective pads 138A through 138C, the number of times of movement of the cleaning pads corresponding to the pads which are currently contacting the charging wire 116 (the pads determined in previous step 230) is incremented by one. In step 244, it is judged whether or not movement of the cleaning pad carrier 130 (cleaning of the charging wire 116) has been carried out the number of times of movement which was determined in previous step 230. If the judgment is negative, the routine returns to step 240, and step 240 through step 244 are repeated until the judgment of step 244 is affirmative. Then, when the judgment of step 244 is affirmative, the cleaning of the charging wire 116 ends, and the routine moves on to step 246.

In this way, the cleaning pad carrier 130 is moved along the charging wire 116, the cleaning pads 138 are slid while being made to contact the charging wire 116, and the charging wire 116 is cleaned. Dirt thereby does not remain on the charging wire 116 after cleaning has ended, and therefore, the performance of the charger 22 can always be maintained in a good state. Further, on the basis of the pre-cleaning surface potential, the post-cleaning surface potential, the driving current value of the motor 122 during cleaning, and the numbers of times of movement of the cleaning pads of each of the pads 138A through 138C, the number of times of re-cleaning and the roughness of the cleaning pads 138 to be used in cleaning are determined, and cleaning of the charging wire 116 is carried out. In this way, cleaning which is suited to the degree of dirtying of the charging wire 116 can be carried out, and it is possible to prevent the cleaning pads 138 and the charging wire 116 from being worn more than needed due to the cleaning pads 138 being slid unnecessarily, and the lifespans of the cleaning pads 138 and the charging wire 116 can be made long.

In step 246, it is judged whether or not the number of times of movement of the cleaning pads has become greater than or equal to a stipulated value. This judgment may be carried out by judging whether or not any of the numbers of times of movement of the cleaning pads of each of the pads 138A through 138C has become greater than or equal to the stipulated value, or may be carried out by judging whether or not the numbers of times of movement of two or more of the pads have become greater than or equal to the stipulated value, or may be carried out by judging whether or not the numbers of times of movement of all of the pads have become greater than or equal to the stipulated value. If this judgment is negative, the routine moves on to step 250. If this judgment of step 246 is affirmative, it can be judged that the end of the lifespan of the cleaning pads 138 has arrived. Therefore, in step 248, a message requesting replacement of the cleaning pads 138 is displayed on the operation panel or the like of the color image forming device 10. In this way, the user or the maintenance operator can recognize that the lifespan of the cleaning pads 138 has arrived.

In next step 250, the motor 122 is driven, the cleaning pad carrier 130 is moved to the pad rotating position (the standby position), and the charging wire cleaning processing ends. Note that, in a case in which the cleaning pad carrier 130 is moved reciprocatingly each time the processing of previous step 240 is carried out, the cleaning pad carrier 130 is already positioned at the pad rotating position (the standby position) at the point in time when the processing of step 240 ends, and therefore, step 250 is unnecessary.

Description is given above of an example in which only one charging wire 116 is provided at the charger 22, and two of the cleaning pads 138 are provided in correspondence therewith. However, the present invention is not limited to the same. For example, as shown in FIG. 9B, in a case in which two of the charging wires 116 are provided, three of the cleaning pads 138 may be provided.

Further, the above describes an example in which the cleaning pad 138 is structured from the three types of pads 138A through 138C which are of respectively different roughnesses and materials. However, the present invention is not limited to the same. As shown in FIG. 9B, the cleaning pad may be structured by two types of pads, or the cleaning pad may be structured by four or more types of pads.

Figure 23:
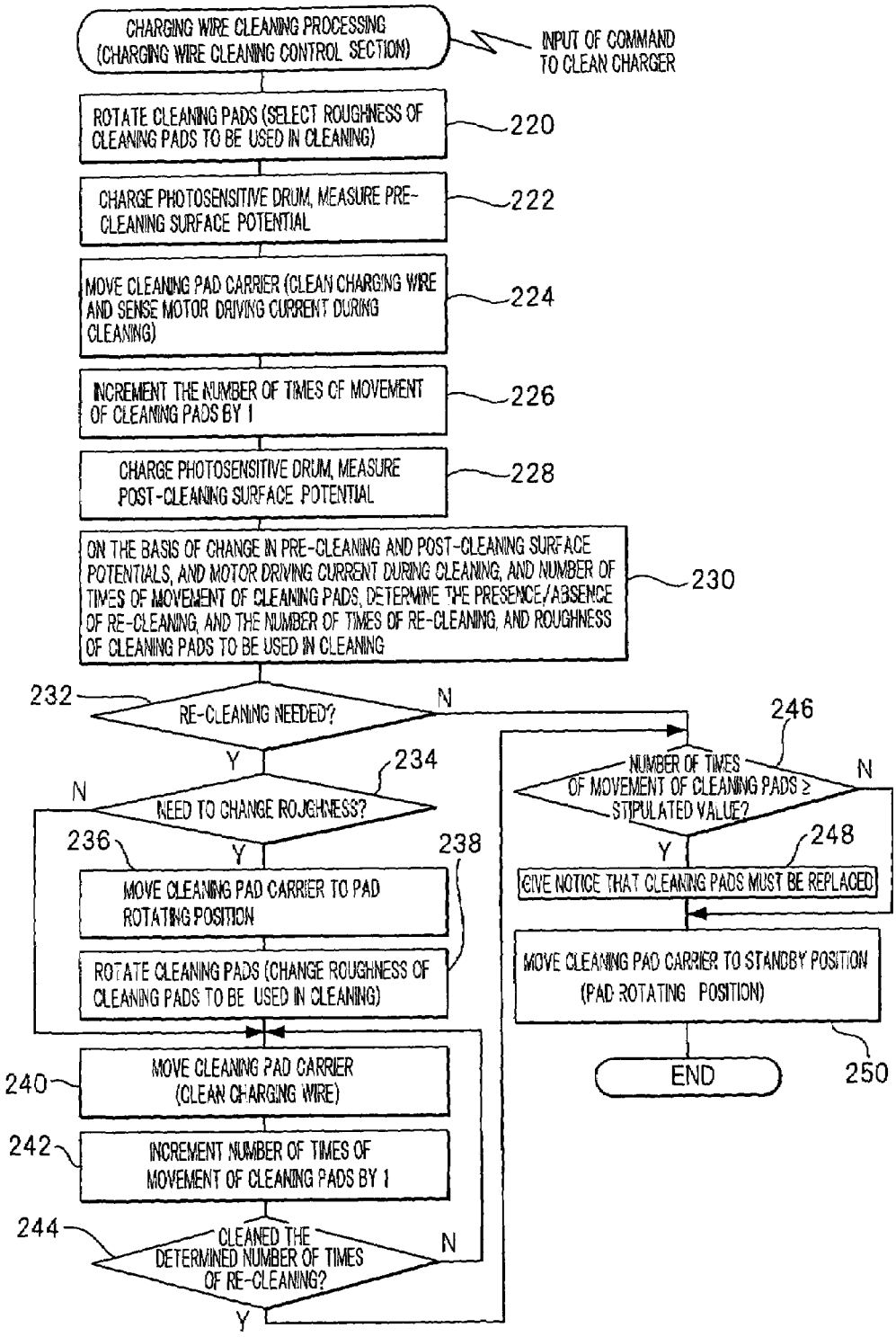
FIG. 23 is a flowchart showing an example of charging wire cleaning processing carried out by a charging wire cleaning control section.
Figure 24:
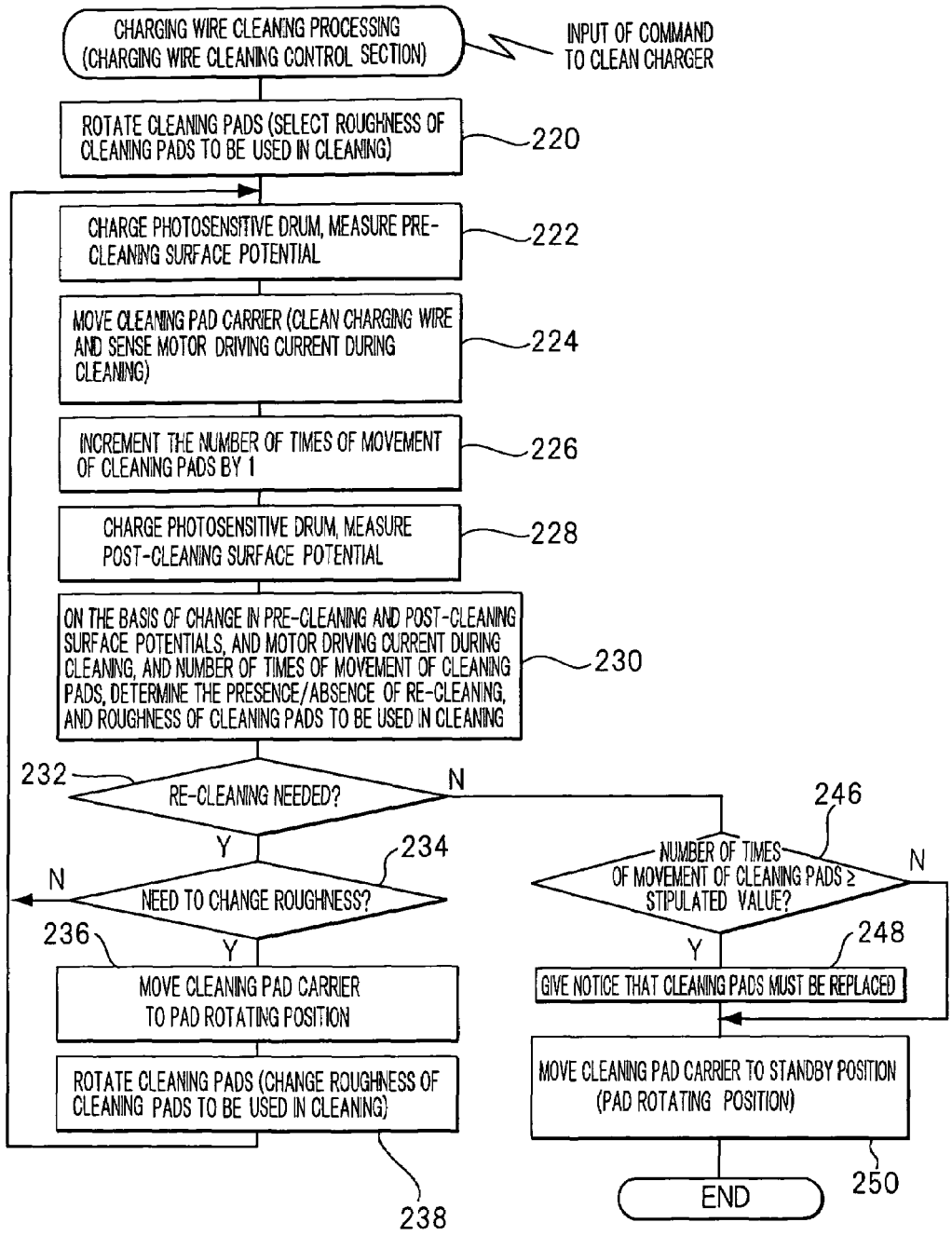
FIG. 24 is a flowchart showing another example of the charging wire cleaning processing carried out by the charging wire cleaning control section.
Figure 25A:
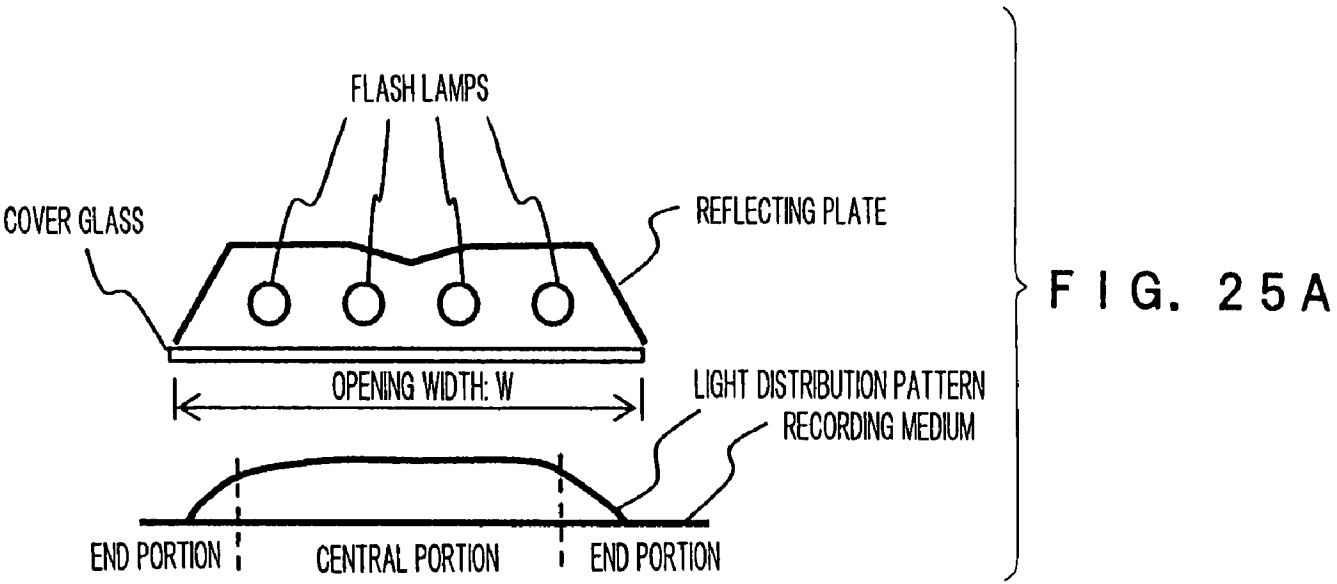
FIG. 25A is a schematic structural diagram of a flash fixing in the related art.
Figure 25B:
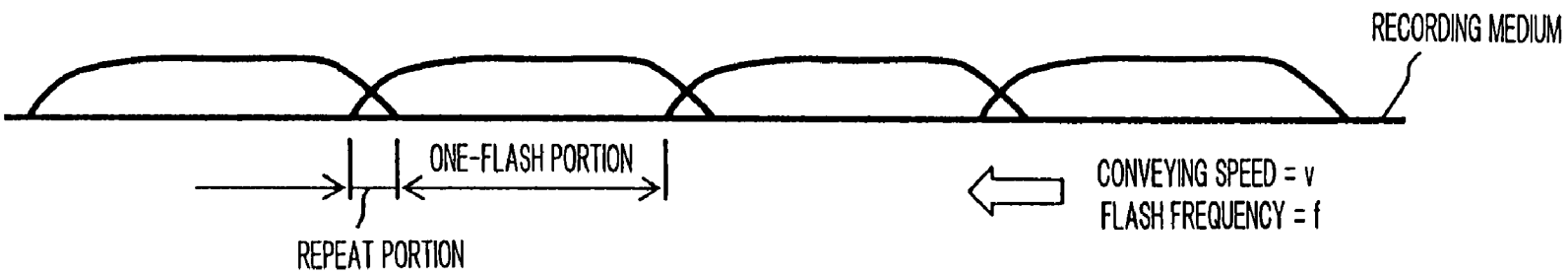
FIG. 25B is a schematic diagram showing the illumination of flash light onto a recording medium, in flash fixing of the related art.
Figure 26A:
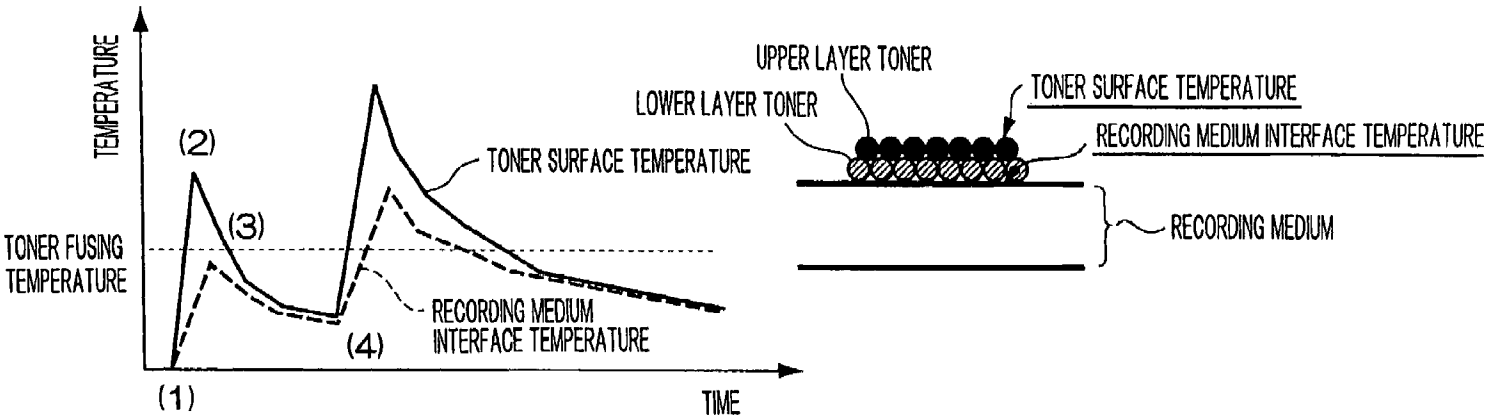
FIG. 26A is a graph showing the progression of temperatures of the toner surface and the recording medium interface, in a repeat region at which a low light amount of flash light is illuminated two times in flash fixing of the related art.
Figure 26B:
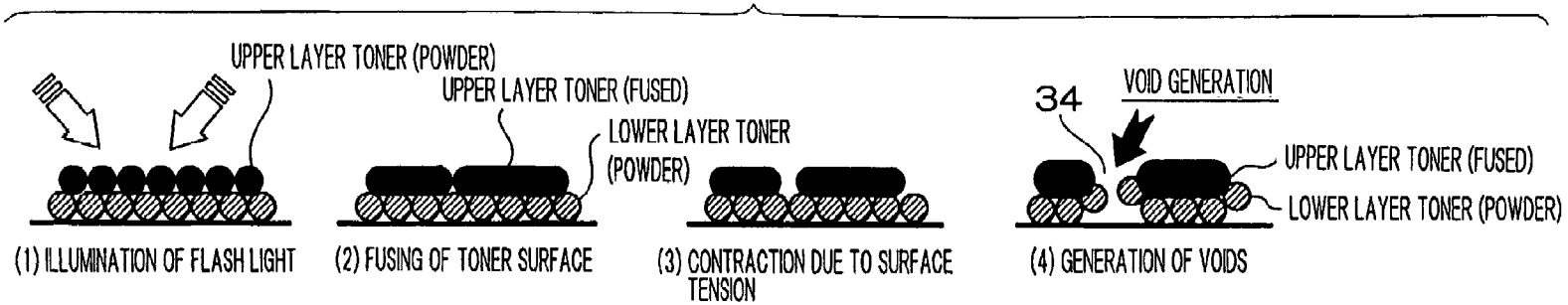
FIG. 26B is a schematic diagram showing the progression of the state of the toner, in the repeat region at which a low light amount of flash light is illuminated two times in flash fixing of the related art.

In the charging wire cleaning processing shown in FIG. 23, first, the change in the surface potential of the photosensitive drum 20 and the magnitude of the driving current of the motor 122 are detected, and whether to carry out re-cleaning or not, the number of times of re-cleaning, and the roughness of the cleaning pads 138 to be used in cleaning are determined. Thereafter, even in a case in which it is judged that re-cleaning is needed, re-cleaning is carried out the determined number of re-cleaning times by the pads of the determined roughness without detecting the surface potential and the driving current at the time of re-cleaning, and the processing ends. However, the present invention is not limited to the same. As shown as an example in FIG. 24, in a case in which, in step 230, only the absence/presence of re-cleaning and the roughness of the cleaning pads 138 to be used in cleaning are determined without determining the number of times of re-cleaning (i.e., in a case in which the judgment in step 232 is affirmative), by returning to step 222 after changing the roughness of the cleaning pads 138 as needed (steps 236, 238), re-cleaning can be carried out while detecting the surface potential and the driving current, and the re-cleaning may be ended at the point in time when it is judged that re-cleaning is unnecessary (i.e., the point in time when the judgment of step 232 is affirmative).

What is claimed is:

1. A flash fixing device comprising:

a group of main flash lamps, formed by a plurality of flash lamps that emit main flash light for fixing a toner image which is transferred onto a recording medium;

a light-emission control unit that causes the group of main flash lamps to emit light intermittently to the recording medium, and the recording medium moves in a predetermined direction relative to the group of main flash lamps, wherein the main flash light is illuminated two times to a region of the recording medium, such that the region of the recording medium corresponds to an edge portion of a light distribution pattern of the main flash light where an amount of light emitted is low; and an auxiliary flash lamp provided at a position between a pair of flash lamps of the group of main flash lamps, the group of main flash lamps being positioned along the predetermined direction, wherein the auxiliary flash lamp is controlled by the light-emission control unit to emit light when the region of the recording medium that repeatedly receives the flash light having the low amount of emitted light matches a position of the auxiliary flash lamp, such that the auxiliary flash lamp is provided at a position at which a distance between the recording medium and the auxiliary lamp is smaller than a distance between the recording medium and the plurality of flash lamps forming the group of main flash lamps.

2. The flash fixing device of claim 1, wherein an outer diameter of the auxiliary flash lamp is smaller than an outer diameter of the plurality of flash lamps forming the group of main flash lamps.

3. The flash fixing device of claim 1, wherein an amount of energy applied to toner as the auxiliary flash lamp emits light is smaller than an amount of energy applied to toner as the plurality of flash lamps forming the group of main flash lamps emit light.

4. The flash fixing device of claim 2, wherein an amount of energy applied to toner as the auxiliary flash lamp emits light is smaller than an amount of energy applied to toner as the plurality of flash lamps forming the group of main flash lamps emit light.

5. The flash fixing device of claim 1, wherein the toner image to be fixed is a color toner image in which toner images of a plurality of colors are superposed over one another.

6. The flash fixing device of claim 1, wherein a plurality of the auxiliary flash lamps is provided.

7. An image forming device comprising:

an image forming section that forms a toner image on an image carrier, and transfers the formed toner image onto a recording medium; and a flash fixing device that fixes the toner image transferred onto the recording medium by illuminating flash light to the recording medium, the flash fixing device comprising:

a group of main flash lamps formed by a plurality of flash lamps that emit main flash light for fixing the toner image transferred onto the recording medium;

a light-emission control unit that causes the group of main flash lamps to emit light intermittently to the recording medium and the recording medium moves in a predetermined direction relative to the group of main flash lamps, wherein the main flash light is illuminated two times to a region of the recording medium, such that the region of the recording medium corresponds to an edge portion of a light distribution pattern of the main flash light where an amount of light emitted is low; and an auxiliary flash lamp provided at a position between a pair of flash lamps of the group of main flash lamps, the group of main flash lamps being positioned along the predetermined direction, wherein the auxiliary flash lamp is controlled by the light-emission control unit to emit light when the region of the recording medium that repeatedly receives the flash light having the low amount of emitted light matches a position of the auxiliary flash lamp, such that the auxiliary flash lamp is provided at a position at which a distance between the recording medium and the auxiliary lamp is smaller than a distance between the recording medium and the plurality of flash lamps forming the group of main flash lamps.

8. The image forming device of claim 7, wherein an outer diameter of the auxiliary flash lamp is smaller than an outer diameter of the plurality of flash lamps forming the group of main flash lamps.

9. The image forming device of claim 7, wherein an amount of energy applied to toner as the auxiliary flash lamp emits light is smaller than an amount of energy applied to toner as the plurality of flash lamps forming the group of main flash lamps emit light.

10. The image forming device of claim 8, wherein an amount of energy applied to toner as the auxiliary flash lamp emits light is smaller than an amount of energy applied to toner as the plurality of flash lamps forming the group of main flash lamps emit light.

11. The image forming device of claim 7, wherein the toner image to be fixed is a color toner image in which toner images of a plurality of colors are superposed one on another.

12. The image forming device of claim 7, wherein a plurality of the auxiliary flash lamps are provided.

13. The image forming device of claim 7, wherein a plurality of image forming sections are provided, each of which comprises:

an exposure head structured so as to irradiate a light beam onto a charged photosensitive drum from a plurality of exposure light sources affixed to one surface of a substrate at substantially uniform intervals along a longitudinal direction of the substrate, thereby forming an electrostatic latent image that is transferred onto the recording medium as the toner image; and each exposure head comprises a positional offset correcting device that corrects a positional offset of the electrostatic latent image caused by a longitudinal elongation/contraction due to a temperature variation of the substrate, based on a detection of the temperature variation of the substrate.

14. The image forming device of claim 13, wherein the each exposure head further comprises a heating unit that heats the substrate, and a temperature detecting unit that detects a temperature of the substrate, wherein the positional offset correcting device comprises a temperature control unit that controls the heating unit based on the temperature of the substrate detected by the temperature detecting unit, an initial value of printing width of each exposure head, and a position of registration mark/marks printed on the recording medium, thereby making the printing widths of the individual exposure heads become substantially equal to each other.

15. The image forming device of claim 14, wherein the heating unit is structured by a wiring pattern of a resistor element provided at the opposite surface side of the substrate, the wiring pattern of the resistor element being configured such that the width thereof is greater at both end portions of the substrate than at a central portion of the substrate.

16. The image forming device of claim 14, wherein the heating unit is structured by a wiring pattern of resistor elements provided at the opposite surface side of the substrate, the wiring pattern of resistor elements being configured such that a heating range of the heating unit is divided into three ranges, which are a central portion of the substrate and both end portions of the substrate, separately providing a wiring pattern of a resistor element at each heating range, and making electrical resistances of the wiring patterns of the resistor elements provided at the both end portions of the substrate smaller than an electrical resistance of the wiring pattern of the resistor element provided at the central portion of the substrate.

17. The image forming device of claim 7, wherein the image forming section comprises a charger including a charging wire that extends in a substantial parallel relationship to an axis of the photosensitive drum and charges the photosensitive drum, wherein the charger comprises a charging wire cleaning device that is structured such that a substantially cylindrical cleaning pad including a plurality of pads which have different properties and are circumferentially arranged is moved along the charging wire while a pad selected from the plurality of pads is maintained in contact with the charging wire, thereby cleaning the cleaning wire.

18. The image forming device of claim 17, wherein the charging wire cleaning device comprises:

a moving unit that moves the cleaning pad along the charging wire;

a rotating unit that rotates the cleaning pad in order to select one of the plurality of pads; and a cleaning control unit that controls the moving unit and the rotating unit.

* * * * *